US011420083B2

(12) United States Patent
Ananth et al.

(10) Patent No.: US 11,420,083 B2
(45) Date of Patent: Aug. 23, 2022

(54) ZWITTERIONIC AND GLUCOSIDE SURFACTANT FORMULATIONS FOR FIRE-FIGHTING FOAM APPLICATIONS

(71) Applicant: The Government of the United States of America, as represented by the Secretary of the Navy, Arlington, VA (US)

(72) Inventors: Ramagopal Ananth, Bryn Mawr, PA (US); Arthur W. Snow, Alexandria, VA (US); Spencer L. Giles, Lorton, VA (US); Matthew Davis, Ridgecrest, CA (US); Katherine Hinnant, Washington, DC (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/569,931

(22) Filed: Jan. 6, 2022

(65) Prior Publication Data

US 2022/0212047 A1 Jul. 7, 2022

Related U.S. Application Data

(60) Provisional application No. 63/134,444, filed on Jan. 6, 2021.

(51) Int. Cl.
*A62D 1/00* (2006.01)
*A62D 1/02* (2006.01)

(52) U.S. Cl.
CPC ..... *A62D 1/0042* (2013.01); *A62D 1/0071* (2013.01)

(58) Field of Classification Search
CPC ..... A62D 1/0042; A62D 1/0071
See application file for complete search history.

(56) References Cited

U.S. PATENT DOCUMENTS 6,680,290 B1 1/2004 Lenoir
9,446,272 B2 9/2016 Blunk et al.
(Continued)

OTHER PUBLICATIONS

Anath et al., "Liquid-Pool Fire Extinction Characteristics of Aqueous Foams Generated from Fluorine-free Surfactants" 36FI-0107, Spring Technical Meeting, Eastern States Section of the Combustion Institute, Mar. 4-7, 2018.
(Continued)

*Primary Examiner* — Andrew J. Oyer
(74) *Attorney, Agent, or Firm* — US Naval Research Laboratory; Joseph T. Grunkemeyer

(57) ABSTRACT

A composition having water and first and second surfactants having the formulas below. The values m and y are non-negative integers, and n and x are positive integers. R is a zwitterionic group. R' is a siloxane group. A foam of the composition may be used to extinguish a fire.

18 Claims, 20 Drawing Sheets

Poly(oxyethyle
Tetrasiloxane-polyoxyethylene-betaine

Poly(glucoside)-alkane

Poly(ethylene glycol) monoalkyl ether, z = 1-6, p= 1-8

(56) References Cited

U.S. PATENT DOCUMENTS

| | | | | |
|---|---|---|---|---|
| 9,687,686 | B2 | 6/2017 | Blunk et al. | |
| 11,117,008 | B2 | 9/2021 | Ananth et al. | |
| 2005/0245158 | A1 | 11/2005 | Yahaioui et al. | |
| 2019/0321670 | A1 * | 10/2019 | Ananth | A62C 99/0036 |
| 2021/0387033 | A1 | 12/2021 | Ananth et al. | |

OTHER PUBLICATIONS

Conroy et al., "Surface Cooling of a Pool Fire by Aqueous Foams" Combustion Science and Technology 2017, vol. 189, No. 5, 806-840.

Hinnant et al., "Evaluating Foam Degradation and Fuel Transport Rates through Novel Surfactant Firefighting Foams for the Purpose of AFFF Perfluorocarbon Replacement" Spring Technical Meeting, Eastern States Section of the Combustion Institute, Mar. 4-7, 2018.

Hinnant et al., "Influence of fuel on foam degradation for fluorinated and fluorine-free foams" Colloids and Surfaces A: Physicochem. Eng. Aspects 522 (2017) 1-17.

Hinnant et al., "Simultaneous measurement of fuel transport and foam degradation for firefighting foams to improve understanding of fire suppressing mechanisms" 11th U. S. National Combustion Meeting Organized by the Western States Section of the Combustion Institute Mar. 24-27, 2019.

Hinnant et al., "Measuring fuel transport through fluorocarbon and fluorine-free firefighting foams" Fire Safety Journal 91 (2017) 653-661.

Hinnant et al., "An Analytically Defined Fire-Suppressing Foam Formulation for Evaluation of Fluorosurfactant Replacement" J. Surfact. Deterg. 21, 711-722 (2018).

* cited by examiner

Commercially available
Small specialty companies
(SciFinder)

Commercially available
n = 0 (Acros Organics, 102860010)
n = 1 (Acros Organics, 449032500)
n = 2 (Gelest, ENEA0170)

Commercially available
Small specialty companies
(SciFinder)

ZWITTERIONIC AND GLUCOSIDE SURFACTANT FORMULATIONS FOR FIRE-FIGHTING FOAM APPLICATIONS

This application claims the benefit of U.S. Provisional Application No. 63/134,444, filed on Jan. 6, 2021. The provisional application and all other publications and patent documents referred to throughout this nonprovisional application are incorporated herein by reference.

TECHNICAL FIELD

The present disclosure is generally related to fire suppressant materials.

DESCRIPTION OF RELATED ART

Prior to the 1960s, foams based on proteinaceous waste products were used to extinguish hydrocarbon fuel fires (Ratzer, "History and Development of Foam as a Fire Extinguishing Medium", *Ind. Eng. Chem.* 48, 2013, 1956). In the 1960s fluorocarbon surfactants were introduced to fire-fighting foam formulations and largely displaced the slow acting protein foams (Tuve et al., "Compositions and Methods for Fire Extinguishment and Prevention of Flammable Vapor Release", U.S. Pat. No. 3,258,423, 1966; Tuve et al., "A New Vapor-Securing Agent for Flammable-Liquid Fire Extinguishment", Naval Research Laboratory Report 6057, DTIC Document No. ADA07449038, Washington D.C., 1964). It was proposed that the fluorocarbon surfactants form an aqueous film under the foam layer that seals off fuel vapors emerging from the pool surface. The aqueous film was attributed to spread on the pool surface because of fluorocarbon surfactants reduce the surface tension to an extremely low value (<17 dynes/cm). The foam layer's role was thought to protect the aqueous film from heat and was a water delivery mechanism to the aqueous film. The aqueous film was considered to be responsible for the high fire suppression performance of aqueous film forming foam (AFFF). AFFF formulations over time have evolved into complex recipes with many ingredients to serve multiple purposes. Many commercial AFFF formulations are understandably complex and proprietary. Hydrocarbon surfactants were added to the fluorocarbon surfactants for dynamic surface tension to reach its equilibrium value more quickly to accelerate spreading of the aqueous film. Other components in addition to water include: organic solvents (viscosity control, storage stabilization at subzero or elevated temperatures); polymers (precipitated barrier formation on polar/alcohol fuels); salts (surfactant shielding); chelating agents (polyvalent ions sequestering); buffers; corrosion inhibitors; and biocides (Martin, "Fire-Fighting Foam Technology" in *Foam Engineering: Fundamentals and Applications*; P. Stevenson, Ed.; Ch. 17, Wiley-Blackwell, West Sussex, UK, 2012). The patent by Norman and Regina discloses some particularly informative recipe examples (U.S. Pat. No. 5,207,932). Since their introduction, AFFFs have been used by civilian and military organizations worldwide including most airports internationally and are considered the equivalent of a gold standard in pool firefighting because of their high fire suppression performance, which is defined more generally as the ability to extinguish completely a given fire quickly using minimal amount of solution. The fire performance is defined more specifically by U.S. MilSpec Mil-F-24385F, which is used to certify the performance of AFFFs for use in DOD firefighting applications and is probably the most stringent compared to other standards of performance (e.g., International Civil Aviation Organization-ICAO, Underwriters Laboratories Inc.-UL) used in civilian applications. One of the test performed under U.S. MilSpec is a fire extinction test that specifies that a 6-ft diameter gasoline pool fire be extinguished in less than 30 s using less than 1 U.S. gallon of solution.

While fluorocarbon-containing AFFF formulations have been highly effective, the fluorocarbon surfactants contained in AFFF are found to pose serious environmental and health hazards (Moody et al., "Perfluorinated Surfactants and Environmental Implications of their Use in Firefighting Foams", *Environ. Sci. Tech.,* 34, 3864, 2000). Elimination or replacement of the fluorocarbon surfactant component in the AFFF formulation is an important and imperative research objective; legal authorities such as U.S. EPA and equivalent European government agencies have been restricting the use of fluorocarbons in firefighting foams either on a voluntary basis or by law, and may in the future require a total discontinuation (Zhang et al., "Review of Physical and Chemical Properties of Perfluoro Octanyl Sulphonate (PFOS) with Respect to its Potential Contamination on the Environment", *Adv. Mater. Res.,* 518, 2183, 2012). In addition to the environmental and health hazards, there has always been an economic driver in place for many years as the cost of the fluorocarbon surfactants "represents 40-80% of the cost of the concentrate" (U.S. Pat. No. 5,207,932).

Fluorine-free surfactant formulations may significantly reduce the environmental and health impact as they do not contain one of the most stable bonds in organic chemistry between carbon and fluorine. However, the problem is that it is extremely difficult to achieve aqueous film formation without the fluorine due to the inability to achieve extremely low surface tension (<17 dynes/cm). After decades of research, the firefighting community has not been able to find fluorine-free surfactants that reduce the surface tension to extremely low values. In 2016, a fluorine-free fire suppressing formulation containing a surfactant composed of a glucoside head group bonded to a siloxane tail group was custom synthesized (Blunk et al., U.S. Pat. No. 9,446,272, Sep. 20, 2016 and U.S. Pat. No. 9,687,686, Jun. 27, 2017. A formulation containing the custom synthesized trisiloxane with a glucoside head group, a hydrocarbon surfactant (Glucopon 215 UP, BASF Inc.), and a solvent (di-glycol butyl ether, DGBE) was able to lower the surface tension to 20 dynes/cm to achieve the aqueous film formation marginally on a limited number of fuels (Kerosene and jet fuel) having relatively high surface tension. The siloxane formulation was unable to form an aqueous film on n-heptane or gasoline fuel, which is employed in U.S. MilSpec tests (Mil-F-24385F). Furthermore, the siloxane surfactant was a prepared by a multistep synthesis with relatively low yield, which is of questionable practicality for large scale synthesis. Blunk et al. also considered four, non-glucoside, trisiloxane surfactants as counter-examples for comparison that did not form the aqueous film. They were tri-siloxanes with oxyethylene head groups (4, 6, and 12 unit lengths) terminated with hydroxyl similar to the commercial tri-siloxane surfactant component described in U.S. Pat. No. 11,117,008 (Sep. 14, 2021) and *Colloids and* Surfaces A, 579, 123686, 2019. However, Blunk et al. rejected the trisiloxanes with oxyethylene head group for fire suppression on the basis that the siloxanes did not form the aqueous film. In summary, no fluorine-free replacement surfactants have been found with film formation ability comparable to that of AFFF on low surface tension fuels such as gasoline.

To compensate for the loss of the aqueous film, the foam industry (e.g., RF6, Solberg, Inc. product and Angus 3%, National Foam, Inc. product) developed fluorine-free foams that reduce drainage and hold more water in the foam layer. The increased liquid content in the foams was achieved by using hydrocarbon surfactants and viscosity modifying additives to control liquid loss by drainage from the foams. However, these approaches to replacing the fluorocarbon surfactants sacrifice AFFF's high fire suppression performance because of the use of less fuel resistant hydrocarbon surfactants and excess solution for comparable fire extinction time. Because only a limited amount of the solution can be carried to the fire site, the commercial fluorine-free foams will not be able to put out large fires as quickly as AFFF on a per unit mass of liquid basis. As a result, the fluorine-free formulations are not expected or claimed to have passed the more stringent U.S. MilSpec Mil-F-24385F by the manufacturers. However, some of the commercial fluorine-free foams have been qualified by European standards (ICAO) for civilian firefighting applications.

In summary, all surfactant AFFF formulations to date that meet the Military Specification (MilSpec) requirements for fire extinguishing (Mil-F-24385F) contain fluorocarbon surfactants. Fluorine-free firefighting foam formulations do exist but to date have not met the MilSpec requirements. Devising a fluorine-free, MilSpec compliant AFFF formulation is a current challenge for research.

It has been demonstrated that fuel vapor resistance property of surfactants is crucial for fire suppression efficiency rather than a liquid layer either in the form of aqueous film formation or high liquid content of foams (Hinnant et al., "Measuring Fuel Transport through Fluorocarbon and Fluorine-free Firefighting Foams", *Fire Safely Journal,* 91, 653-661, 2017 and Hinnant et al., "Influence of Fuel on Foam Degradation for Fluorinated and Fluorine-free Foams", *Colloids and Surfaces A,* 522, 1-17, 2017). A siloxane formulation containing 0.2 weight % commercial non-ionic siloxane surfactant (Dowsil 502W additive, Dow Silicones Co., Midland, Mich.), 0.3 weight % Glucopon225DK (BASF Inc.), and 0.5 weight % diethyleneglycol butylether (DGBE, Dow Chemical Co.) in deionized water can be used to generate foam that suppresses heptane pool fires at bench and large scales (U.S. Pat. No. 11,117,008 (Sep. 14, 2021) and *Colloids and Surfaces A,* 579, 123686, 2019). A 3% concentrate of this formulation has low viscosity unlike most of commercial fluorine-free formulations available on the market. The high viscosity of the commercial fluorine-free formulations prevents them from being qualified for US DOD use as depicted in MIL-PRF-24385 as drop-in replacements for AFFF. However, the non-ionic siloxane formulation's fire suppression was found to be poor on gasoline fires at bench and large scales (NRL Memorandum Report NRL/MR/6180-20-10,145). This appears to be due to siloxane surfactant extraction by gasoline (NRL Memorandum Report NRL/MR/6180-20-10,145).

BRIEF SUMMARY

Disclosed herein is a composition comprising water and first and second surfactants having the formulas below. The values m and y are independently selected non-negative integers, and n and x are independently selected positive integers. R is a zwitterionic group. R' is a siloxane group (1)

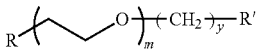

-continued (2)

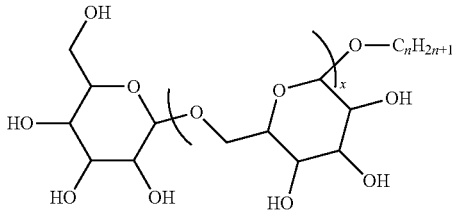

Also disclosed herein is a method of forming the above composition.

BRIEF DESCRIPTION OF THE DRAWINGS

A more complete appreciation will be readily obtained by reference to the following Description of the Example Embodiments and the accompanying drawings.

DETAILED DESCRIPTION OF EXAMPLE EMBODIMENTS

Figure 1:
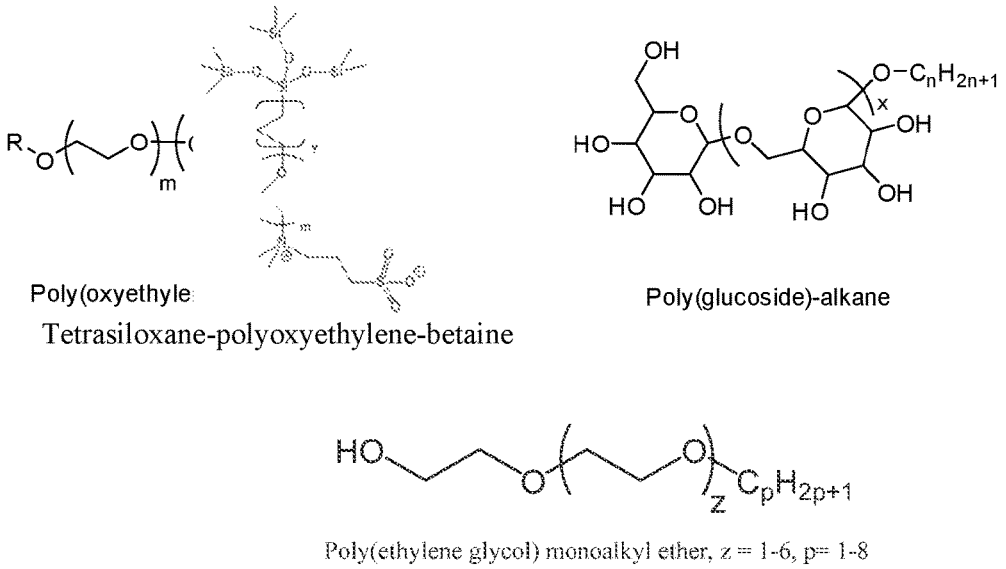
FIG. 1 shows classes of surfactant and solvent structures.

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Disclosed herein is the preparation of fluorine-free surfactant formulations to generate foams that have high fire suppression comparable to that of the firefighting foam currently used world-wide, aqueous film forming foam (AFFF), which contains fluorocarbon surfactants with significant environmental impact. The formulation uses a zwitterionic compound, such as a zwitterionic tetrasiloxane surfactant that may exhibit synergism with alkylglycoside surfactants and result in high fire suppression for gasoline and jet fuel fires. The 3% concentrate of the surfactant solution has low viscosity and is suitable as a candidate for drop-in replacement for AFFFs unlike many commercial fluorine-free formulations. As an example, a surfactant formulation composed of tetrasiloxane sulfobetaine (TSB) and alkyl polyglucoside surfactants and other components is shown to spread extremely quickly, suppress the fuel vapors, and extinguish a gasoline and jet fuel pool fires closer to the values measured for AFFF. The TSB surfactant structural features, synthesis route, and formulation compositions' effect on the foam's resistance to the fuel vapors emerging from the pool surface that correlate with fire suppression effectiveness is described. The structural features include a range of head and tail dimensions. Compositions include the range of relative amounts of siloxane to hydrocarbon surfactants to achieve improved extinction and increased foam spreading on the pool surface. Fuel vapor resistance is quantified by the ranges of fuel/heat induced foam degradation and fuel vapor permeation rate relative to AFFF. Surface and near zero interfacial tensions show tendency for emulsification with fuel that might have led to surface cooling and lowering of fuel vapor pressure, which might have helped to quickly suppress small flamelets that tend to prolong complete fire extinction.

The zwitterionic-siloxane formulation may be effective in suppressing gasoline (alcohol-free) fires with 60% fire suppression effectiveness of Reference AFFF, which was described previously (*Journal of Surfactants and Detergents,* 21, 711-722, 2018), based on benchtop measurements. The zwitterionic-siloxane formulation is also much more effective in suppressing gasoline fires than the non-ionic siloxane formulation described in U.S. Pat. No. 11,117,008. The foams generated from the zwitterionic-siloxane formulation were found to spread more quickly on a burning gasoline pool surface than the non-ionic siloxane formulation. The new zwitterionic siloxane surfactant did not dissolve in gasoline and as a result it can be more effective in blocking fuel vapor permeating through the foam and cutting off fuel supply to the fire. The formulation contains a glycoside and a solvent along with a zwitterionic-tetrasiloxane surfactant. The superior fire suppression effectiveness is due to increased oleophobicity of the tetrasiloxane tail that blocks the fuel vapor permeation through foam covering the pool surface while maintaining amphiphilicity with a zwitterionic head group. Also significant is the possible synergistic interaction with hydrocarbon co-surfactant, where the fire extinction times are smaller for the combination of the surfactants compared to those for the two surfactants individually. The synergism blocks the fuel permeation and contributes to faster extinction without using excess solution. The new formulation also has low viscosity for the 3% concentrate which makes it suitable as a drop-in replacement to AFFF unlike many commercial fluorine-free foams.

The formulation comprises two surfactants and water. The first surfactant (Eq. (1)) contains both a zwitterionic group and a siloxane group. the zwitterionic group may be, for example, a sulfobetaine group or a chlorobetaine group. Suitable values for m may be, for example, 0 to 20, and suitable values for y may be, for example, 0 to 5. Both, neither, or either of m and y may be 0. One suitable first surfactant having a sulfobetaine group is shown in Eq. (3).

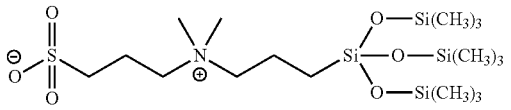

(3)

In the second surfactant (Eq. (2)), suitable values for n may be, for example, 1 to 20, and suitable values for x may be, for example, 0 to 4. The wt. % ratio of the first surfactant to the second surfactant may be, for example, 0.03 to 5. The composition may include more than one of the first surfactant or the second surfactant having different values of m, n, x, or y.

The composition may also include a solvent other than the water, having the structure shown in Eq. (4). The value p is a positive integer, which may be, for example, 1 to 8. The value z is a positive integer, which may be, for example, 1 to 6.

The components of the composition may be mixed by any method. When needed to extinguish a fire, a foam may be made from the composition by methods known in the art. The foam can be applied in an amount sufficient to extinguish the fire.

This formulation advances the development of formulations of fluorine-free surfactants for generation of foams with fuel vapor blocking property and fire suppression activity that approaches the fire extinction performance level of fluorocarbon surfactant containing AFFF formulations for gasoline fires. Both the two-step synthesis of the tetrasiloxane-betaine (TSB) surfactant and fire suppression performance using a formulation containing TSB are reproducible. Previously, a similar result was reported for heptane fires using a formulation containing a commercially available siloxane surfactant. But, the gasoline fires are significantly more difficult to suppress than the heptane fires partly due to gasoline's higher volatility and ability to extract surfactant from the foams causing bubble coalescence and higher fuel transport through a foam layer covering the pool surface. The zwitterionic tetrasiloxane formulation exhibits synergism between TSB and alkylglycoside for gasoline fires similar to the synergism reported previously for a family of nonionic trisiloxanepolyoxyethelene surfactant formulations for heptane pool fires. The zwitterionic tetrasiloxane formulation appears to effectively suppress the fuel permeation through a foam layer leading to suppression of "edge flames" and faster fire extinction despite having shorter foam lifetime compared to the non-ionic trisiloxane 502W formulation. The 3% concentrate of the current formulation is a potential drop-in replacement for AFFF. Very few commercial foams have low viscosity for a 3% concentrate unlike the present formulation and therefore most commercial formulations would require very expensive hardware modifications and are not suitable drop-in replacements for AFFF. The fluorine-free feature is critical for environmental regulation compliance. A methodology is developed where the fuel resistance property measurements are used as metrics to quantitatively rank numerous commercial formulations that enable identification of superior performing fluorine-free surfactant relative to AFFF. In addition near zero interfacial tension of the tetrasiloxane-sulfobetaine formulation may enable formation of fine emulsion containing small aqueous droplets at the fuel pool surface and induce more effective cooling of the hot pool reducing vapor pressure; after fire extinction, visual examination of the left over gasoline fuel layer shows milk like turbidity. This could also explain the observation of reduced edge flame (small flamelets) with the betaine formulation unlike the nonionic trisiloxane 502W formulation. Also, the tetrasiloxane tail may also provide more hydrolytic stability by resisting hydrolysis in dilute aqueous solutions due to stearic crowding relative to the trisiloxane tails.

The general structures of these two surfactant classes can represent commercialized surfactants and analytical or custom synthesized surfactants shown in FIG. 1. The parameter m is from 0 to 20, y is greater than or equal to 0, n is from 1 to 20, and x is greater than or equal to 1. R can be any functional group including a zwitterion, e.g., sulfobetaine, chlorobetaine, etc. It has been demonstrated that when a member of each class with proper specific characteristics is combined in a foam generating formulation, the foam produced displays an effective fire suppression capability. It may or may not also include a solvent whose general class of structure is depicted in FIG. 1 with parameters p and z greater than or equal to 1. The formulation was prepared by mixing the three components shown in FIG. 1 in proportions shown in Table 1 as an example. The ratio of the siloxane to glycoside surfactants can range from 0.03 to 5.

TABLE 1

Fluorine-free formulation containing synthesized tetrasiloxane-sulfobetaine surfactant, a hydrocarbon surfactant (e.g., Glucopon225DK, BASF Inc.), a solvent (diethyleneglycol butylether, DGBE, Dow Chemical Co.) in distilled water. a non-ionic siloxane formulation containing commercial trisiloxanepolyoxyethylene surfactant (Dowsil 502W additive, Dow Silicones Co.). Also shown is reference AFFF formulation (RefAFFF) containing a fluorocarbon surfactant (Capstone 1157, Chemours Inc.).

| Tetrasiloxanebetaine (TSB) formulation | Nonionic trisiloxane formulation[1] | RefAFFF formulation[2] |
|---|---|---|
| 0.065% zwitterionic tetrasiloxane surfactant e.g., tetrasiloxanesulfobetaine | 0.2% trisiloxane surfactant, Dowsil 502W additive | 0.3% Capstone 1157 |
| 0.3% Hydrocarbon surfactant, e.g., Glucopon225DK | 0.3% Hydrocarbon surfactant, Glucopon225DK | 0.2% Glucopon215 CS UP |
| 0.5% solvent, e.g., DGBE | 0.5% solvent, DGBE | 0.5% DGBE |
| 99.135% distilled water | 99% distilled water | 99% distilled water |

[1]U.S. Pat. No. 11,117,008, Colloids and Surfaces A, 579, 123686, 2019

[2]RefAFFF passed the 28 $ft^2$ U.S. Mil-F-24385F fire test with an extinction time of 26 s, burnback time of 562 s, 25% liquid drainage time of 317 s, foam expansion ratio of 7.5 (Title, *Journal of Surfactants and Detergents*, Submitted).

Figure 2:
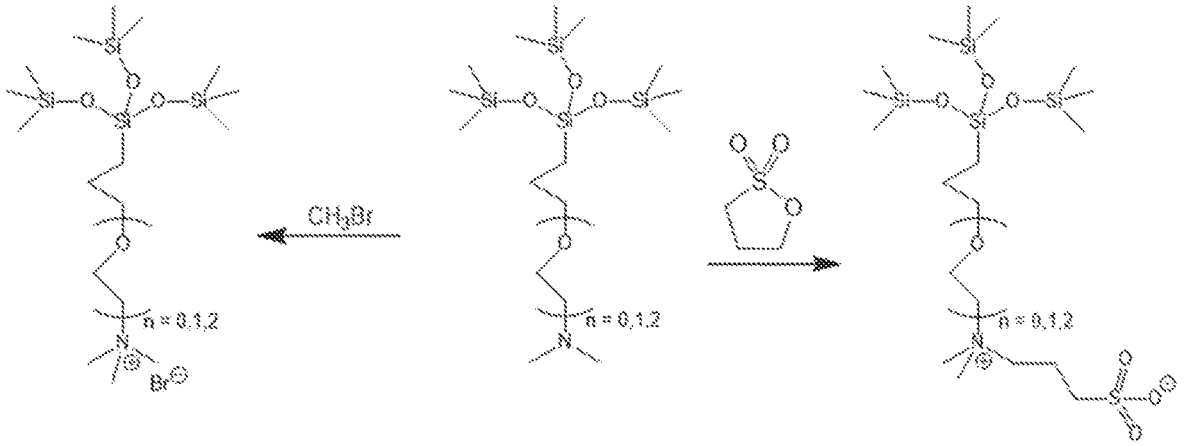
FIG. 2 shows a synthesis of tetrasiloxane-polyoxyethylenesulfobetaine surfactant series.

Tetrasiloxane-sulfobetaine surfactant synthesis—Illustrated FIG. 2 is synthesis of a homologous series of tetrasiloxane-sulfobetaine surfactants being derived from the same amine precursor. An important issue is that the tetrasiloxane tail structure not be degraded by chemistry at the other end of the molecule by making the silylation step as the last one in the synthesis.

Figure 3:
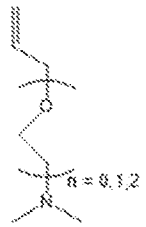
FIG. 3 shows structures of commercially available precursor materials used in the synthesis.
Figure 3:
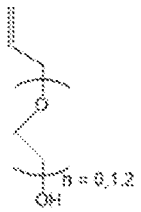
Figure 3:
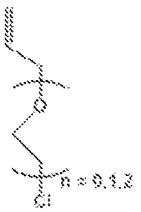

As for starting materials, hydroxyl terminated allylethylene reagents are commercially available. The hydroxyl group can be converted to the dimethylamine group via a chloro-intermediate. Using SciFinder for the amine- and chloro-structures In FIG. 3 indicated that they are available commercially.

Figure 4:
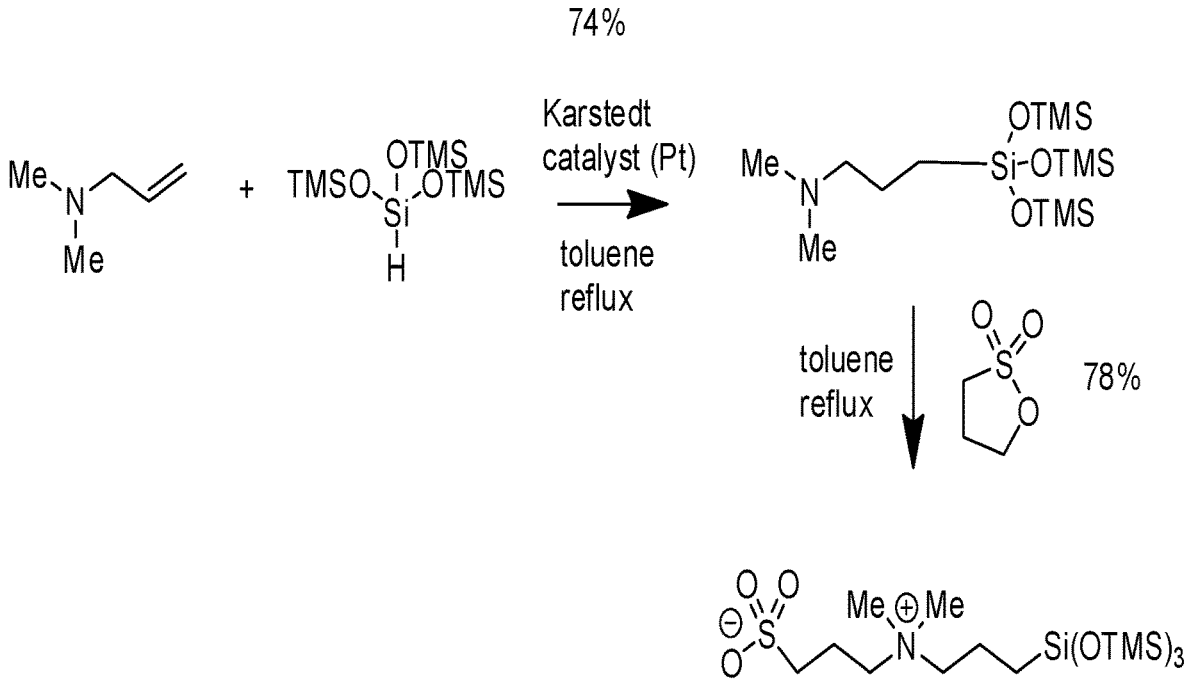
FIG. 4 shows a chemical route to synthesize tetrasiloxane sulfobetaine with zero oxyethylene length (n=0).

A specific tetrasiloxane-sulfobetaine with n=0 (zero oxyethylene length) synthesis was conducted as shown in FIG. 4. TMSO or OTMS stand for trimethylsiloxane displayed in FIGS. 2 and 3. The two-step synthesis gave 74% and 78% conversions for the first and second steps respectively.

Measurements of surfactant properties—The surface tension for the formulation shown in column 1 of Table 1 is 20.2 mN/m and interfacial tensions are near zero for heptane and gasoline measured by DuNoy ring method.

Foam generation and application for fire suppression—Foams can be generated using a device that mixes air and water at different ratios known as the expansion ratio (e.g., volume of foam/volume of liquid). As an example, foams are generated by sparging air continuously at a constant rate through a porous disc while feeding solution continuously to maintain a constant liquid column height (3-cm) above the porous disc (25-50 μm pores, 1.9-cm diameter) by using a leveling system. Foam collects to form a 5.5-cm thick layer above the solution surface while flowing out from a 2.5-cm diameter outlet tube connected to the cap of a 0.7-liter plastic bottle (7.6-cm diameter, 15.9-cm height). Foam flow rate is maintained constant during fire extinction and is measured by recording time taken to collect 500 mL volume before and after fire extinction. Foam expansion ratio (volume of foam/weight of foam) is also measured before and after each fire extinction experiment in order to calculate liquid flow rate (foam flow rate/expansion ratio). To apply the foam continuously on to a burning fuel pool, the outlet tube from the foam generating plastic bottle is placed about 1-inch above the pool surface. The foam is applied directly at the near-edge of a burning gasoline (alcohol-free) pool (circular shape) and allowed to spread across the pool to cover it and until fire extinction, or a maximum time of 5 minutes if there is no extinction. Extinction experiments are conducted at different values of liquid (or foam) flow rates. The gasoline pool is allowed to burn for 60 s (preburn time) prior to the foam application. The pool consisted of 1-cm thick fuel layer above a 5-cm thick water layer. The fuel level is maintained at 1-cm below the rim of the 19-cm diameter crystallizing dish to accommodate the foam and prevent overflow of the fuel by using a leveling system. The apparatus used for generating the foams and conducting fire extinction were developed previously (*Journal of Surfactants and Detergents,* 21, 711-722, 2018).

Figure 5A:
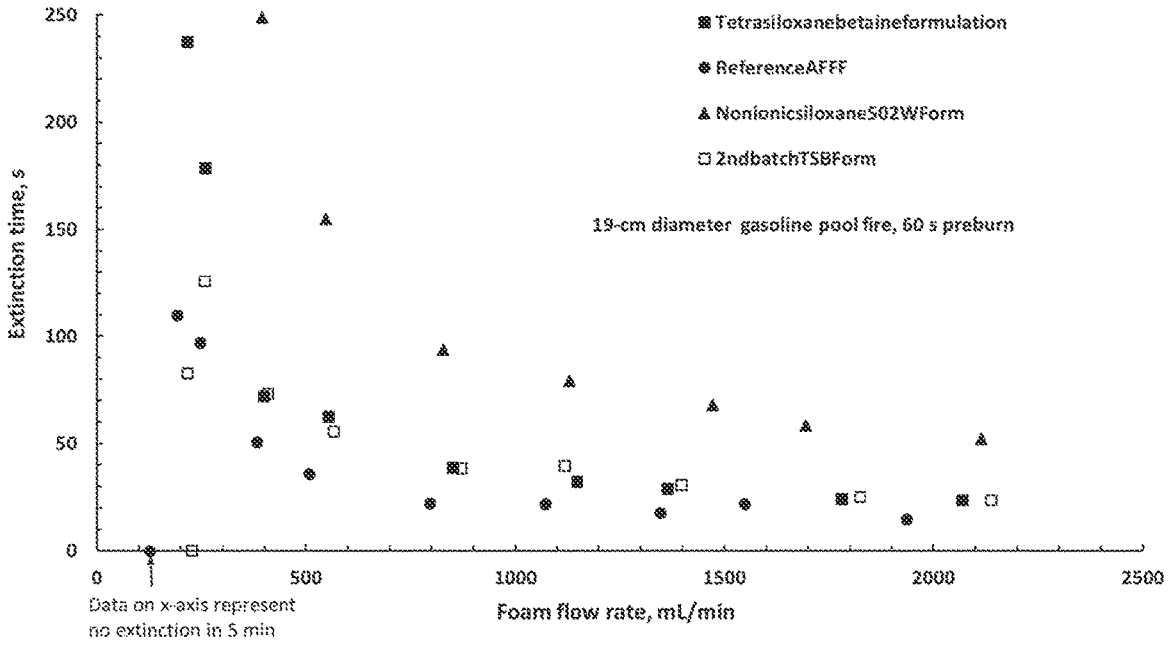
FIGS. 5A and B show fire performances (A) extinction time versus foam application rate onto the edge of a 19-cm diameter gasoline pool fire for the tertasiloxanesulfobetaine formulation (solid squares), a 3-component RefAFFF (solid circles), and a non-ionic siloxane (502W-Glucopon225DK, solid triangles) surfactant formulation with compositions shown in Table 1. The tetrasiloxane betaine formulation was synthesized a second time and fire extinction evaluated (open squares), (B) extinction time versus surfactant solution flow rates.
Figure 5B:
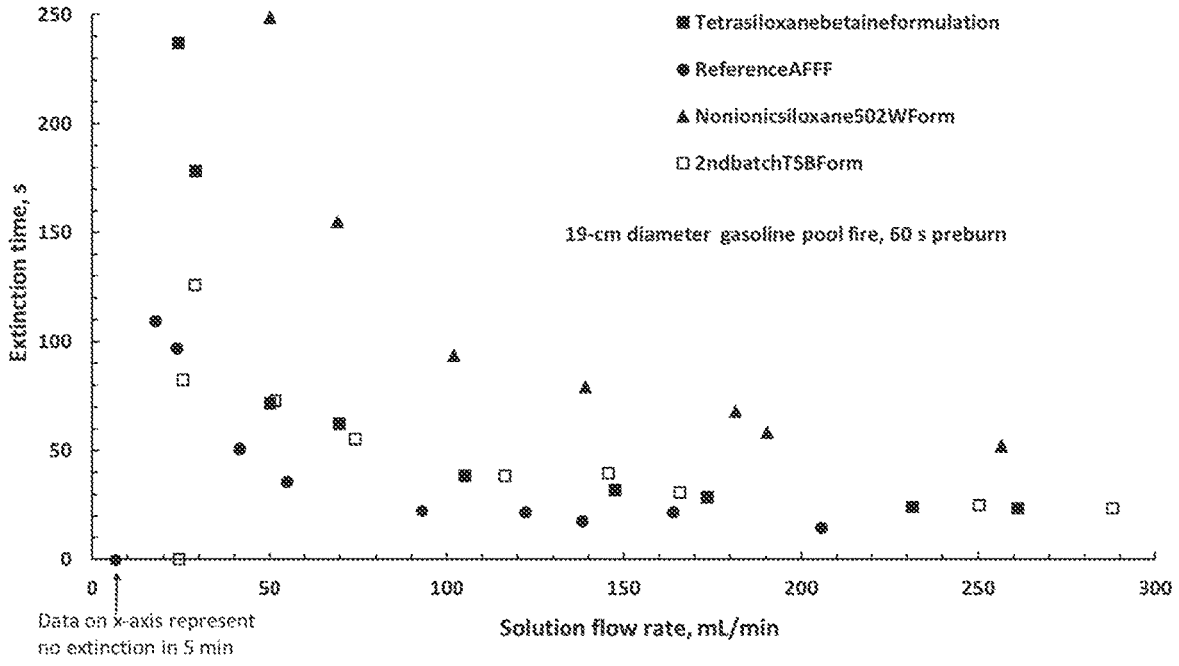

Fire extinction can be conducted by applying the foams from the foam generating device on to a burning liquid fuel pool at different application rates. Examples of such testing results are depicted in FIGS. 5A and 5B where the extinction time is measured as a function of measured foam and solution flow rates. For comparison, extinction results for the non-ionic trisiloxane and RefAFFF formulations listed in Table 1 are shown in FIGS. 5A and B. These results demonstrate that the zwitterionic siloxane formulation is a significant improvement over the nonionic siloxane formulation and is close the extinction profile of RefAFFF. The extinction times for the zwitterionic siloxane formulation are about 1.6 times that of RefAFFF. The MilSpec solution application rate of 2 gallons per minute for a 28 $ft^2$ gasoline fire corresponds to 2.9 $kg/min/m^2$, which corresponds to a solution flow rate of 82 mL/min for the 19-cm diameter bench scale data shown in FIG. 5B.

Figure 6A:
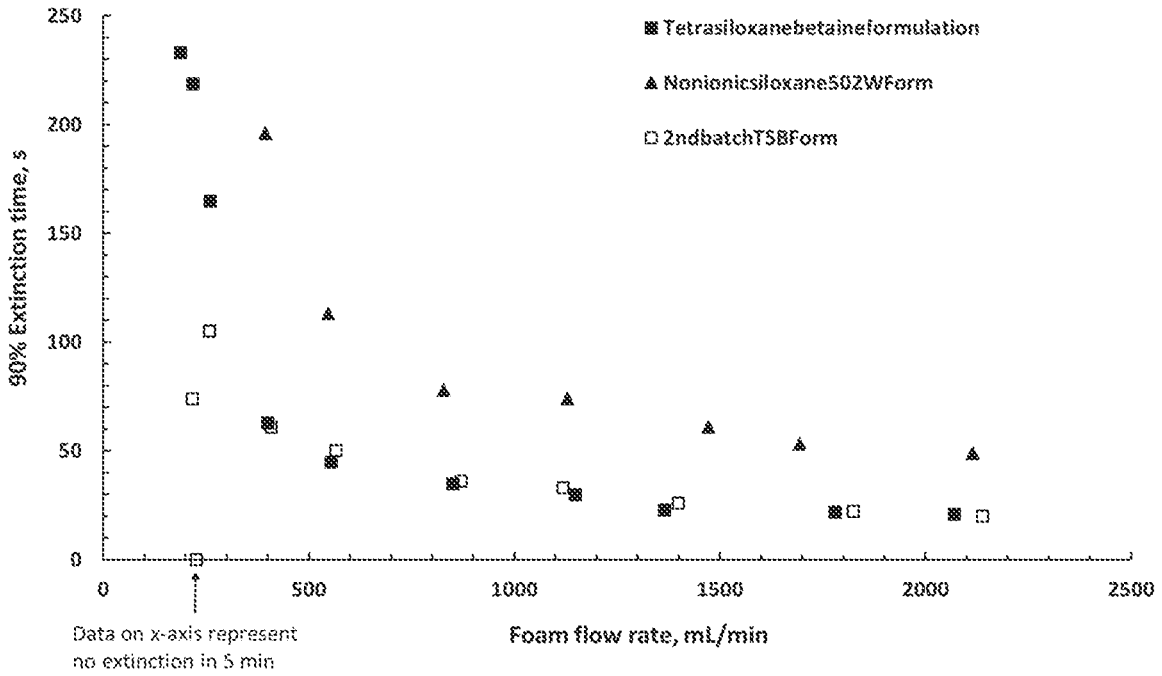
FIGS. 6A and B show fire performances (A) 90% extinction time versus foam application rate onto the edge of a 19-cm diameter gasoline pool fire for the tertasiloxanesulfobetaine formulation (solid squares), a 3-component RefAFFF (solid circles), and a non-ionic siloxane (502W-Glucopon225DK, solid triangles) surfactant formulation with compositions shown in Table 1. The tetrasiloxanesulfobetaine formulation (2ndbatchTSBForm) was synthesized second time and fire extinction evaluated (open squares), (B) 90% extinction time versus surfactant solution flow rates.
Figure 6B:
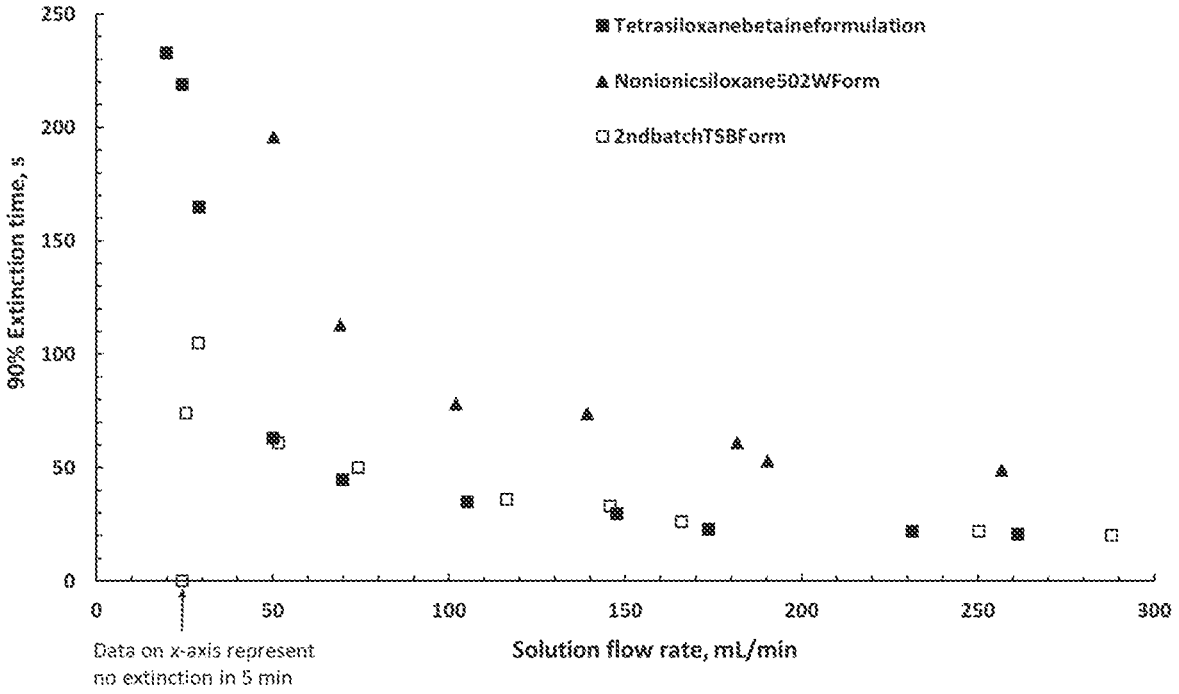
Figure 7A:
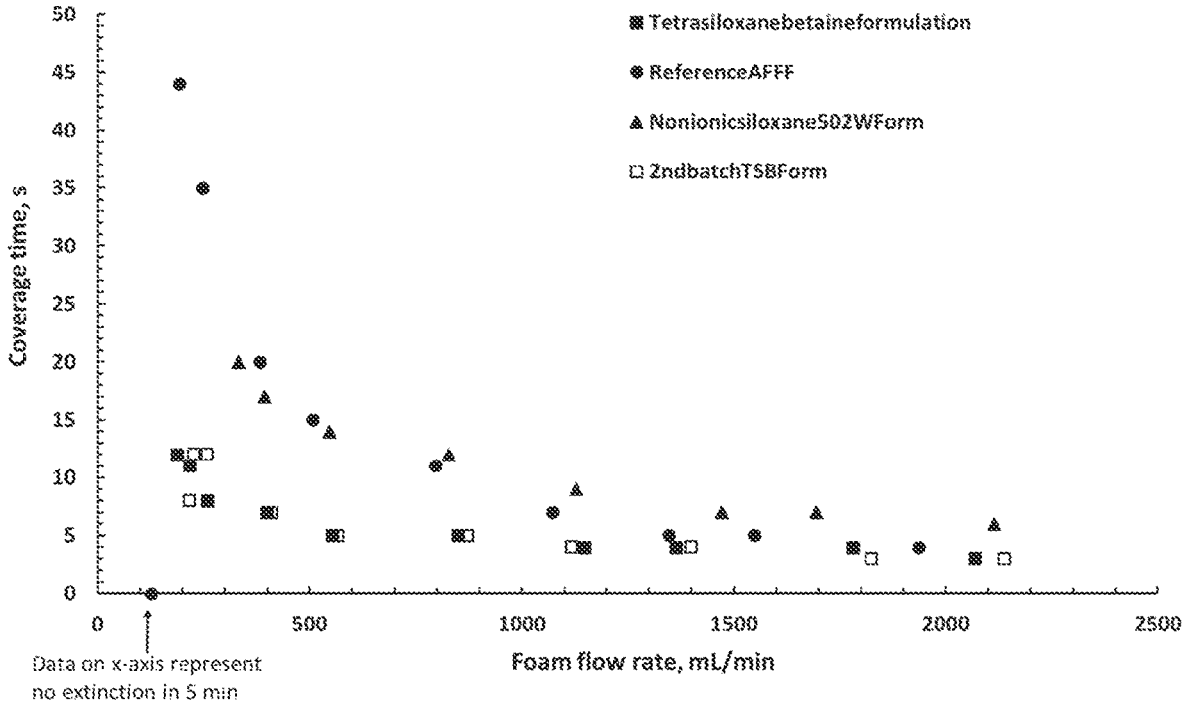
FIGS. 7A and B show fire performances (A) pool coverage time versus foam application rate onto the edge of a 19-cm diameter gasoline pool fire for the tertasiloxanesulfobetaine formulation of this invention (solid squares), a 3-component RefAFFF (solid circles), and a non-ionic siloxane (502W-Glucopon225DK, solid triangles) surfactant formulation with compositions shown in Table 1. The tetrasiloxanesulfobetaine formulation was synthesized second time and fire extinction evaluated (open squares), (B) extinction time versus surfactant solution flow rates.
Figure 7B:
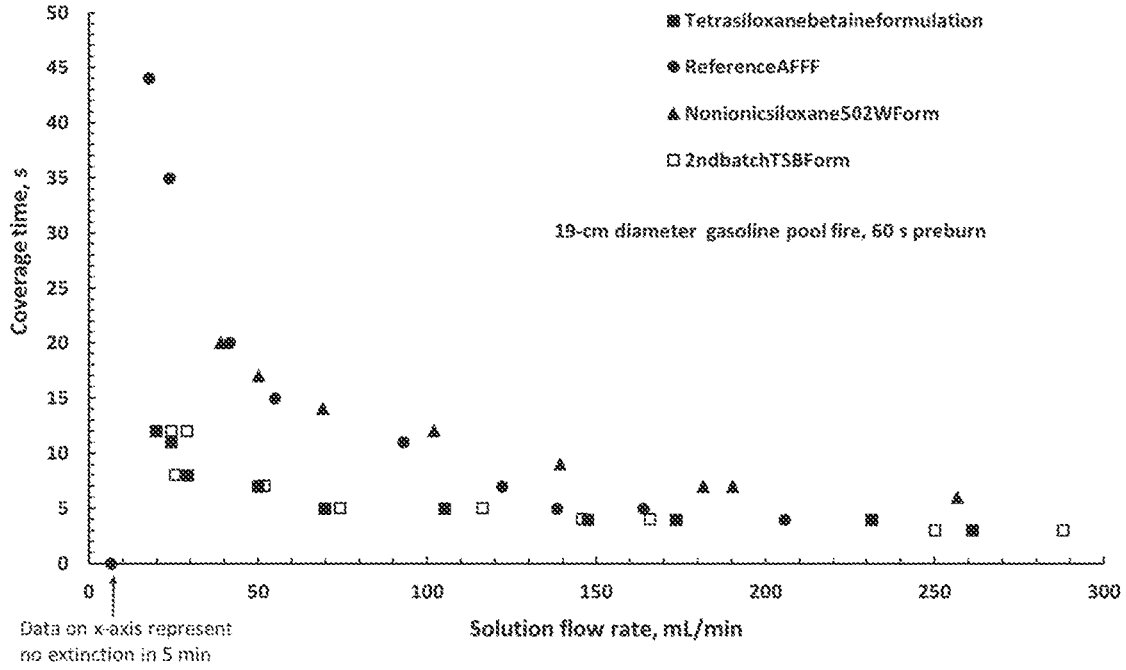

FIGS. 6A and B show 90% fire extinction profile for the three formulations listed in Table 1. The extinction time data were collected when 90% of the pool area was extinguished but small edge flames lingered before complete fire extinction. The 90% extinction times are much closer to the complete extinction times displayed in FIGS. 5A and B because of reduced "edgeflames". Edgeflames are small flamelets that linger on the pool surface and prolong complete fire extinction despite fire being extinguished on most of the pool surface. Again, the zwitterionic formulation is much closer to RefAFFF profile than the nonionic siloxane formulation. FIGS. 7A and B show time taken by the foams to fully cover the pool surface for the formulations listed in Table 1. The coverage times are much smaller for the zwitterionic siloxane formulation than either the nonionic siloxane formulation and even RefAFFF.

It may be noted that the superior fire extinction performance of the tetrasiloxanesulfobetaine formulation may be due to a synergism between the tetrasiloxane and poly (glucoside)-alkane surfactant components on gasoline pool fires. The fire extinction time for the mixture of siloxane and glucoside components is far less than the extinction time profile of equivalent quantities of each surfactant component alone. An example of this result is depicted by the plot in FIGS. 8A and B.

Figure 8A:
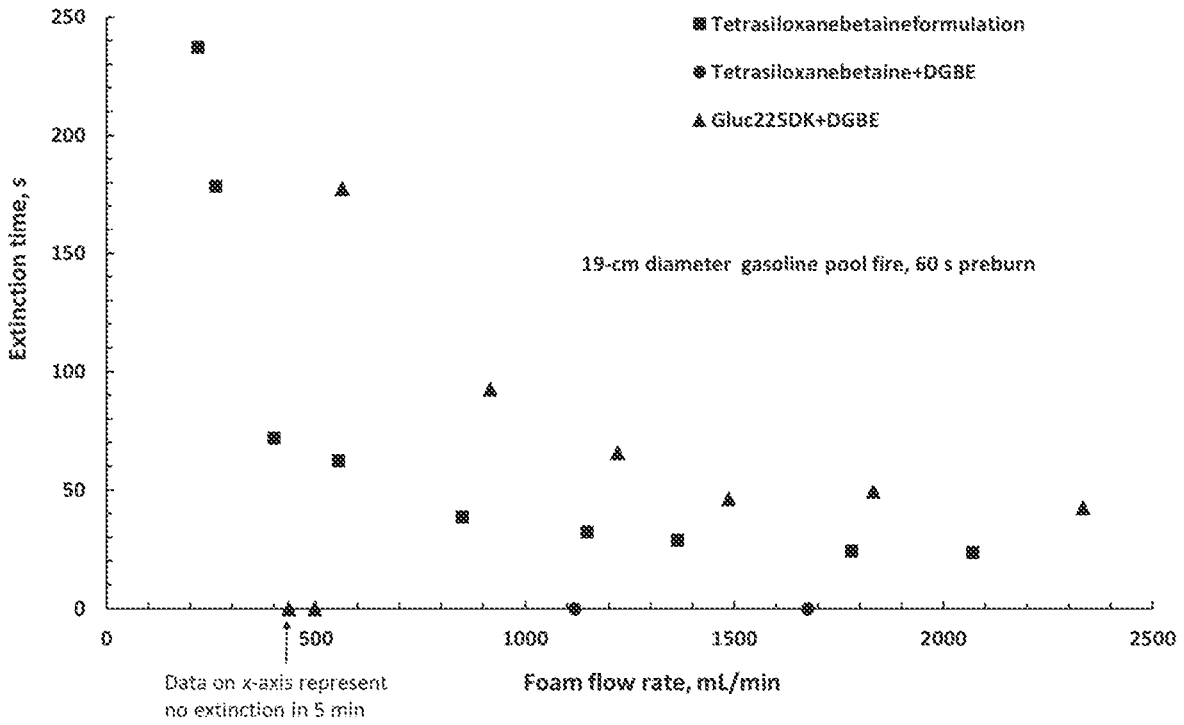
FIGS. 8A and B show (A) fire performances of extinction time vs foam flow rate for the present formulation of the two surfactants (solid square) listed in Table 1, and the individual surfactants alone (solid circle and solid triangle) showing synergistic extinction and (B) Extinction time vs solution flow rate for the mixture and the individual components.
Figure 8B:
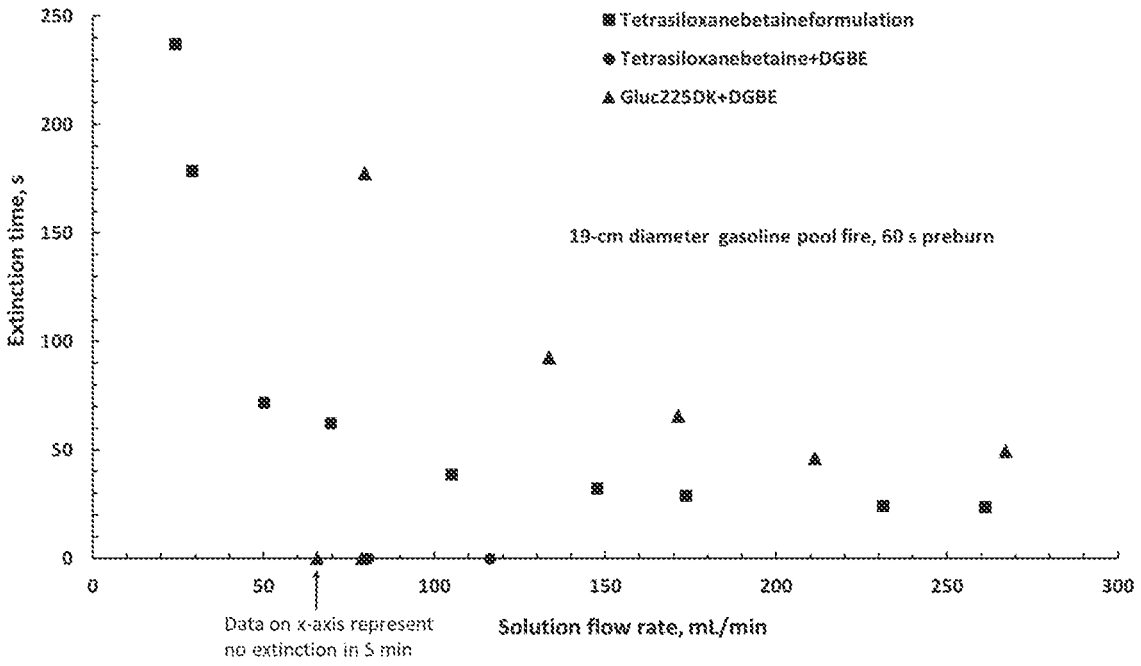

FIGS. 8A and B show that 0.065 weight % tetrasiloxanesulfobetaine with 0.5 weight % DGBE in water solution could not extinguish a gasoline pool fire even at a very high (1675 mL/min foam flow rate or 116 mL/min liquid flow rate) foam flow rate as indicated by the circles along the x-axis. 0.065 weight % tetrasiloxanesulfobetaine solution is at the limit of the surfactant solubility in water as indicated by the haziness of the solution. A solution containing 0.3 weight % Glucopon225DK with 0.5 weight % DGBE in water performs significantly better than the siloxane with DGBE solution. But, the extinction performance of Glucopon with DGBE falls well short of the formulation containing both the tetrasiloxanesulfobetaine (0.065 weight %) and Glucopn225DK (0.3 weight %), and DGBE (0.5 weight %). A similar synergism for heptane fire suppression was not found with the tetrasiloxanesulfobetaine formulation listed in Table 1. Previously, it was shown that there was a similar synergism between the nonionic trisiloxanepolyoxyethylene surfactant (Dowsil 502W additive) and Glucopon 225DK for heptane fire suppression, but no such synergism was found for gasoline. By synthesizing homologous series of trisiloxanepolyoxyethylene surfactants, synergism was shown between a family of trisiloxane surfactants with varying oxyethylene head and a family of alkylglycosides with varying head and tail sizes (NRL Memorandum Report NRL/MR/6180-20-10,145).

Figure 9A:
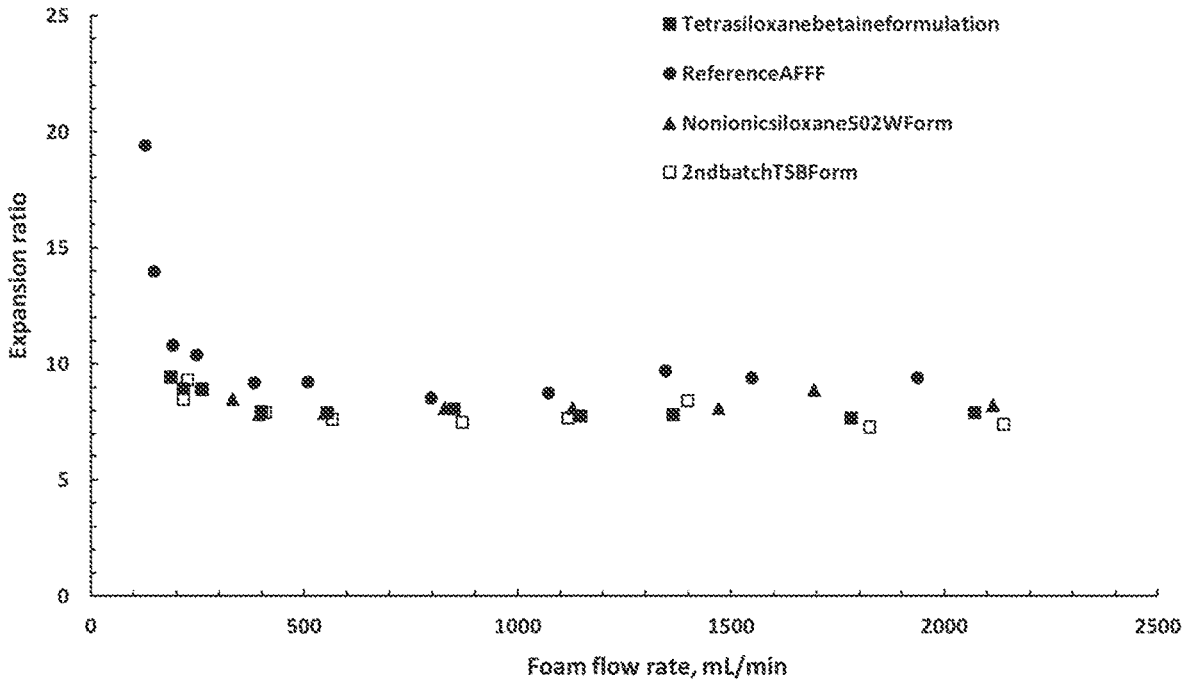
FIGS. 9A and B show (A) expansion ratio vs foam flow rate for the formulations listed in Table 1 and (B) expansion ratio vs foam flow rate for the present formulation of the two surfactants (solid square) listed in Table 1, and the individual surfactants alone (solid circle and solid triangle).
Figure 9B:
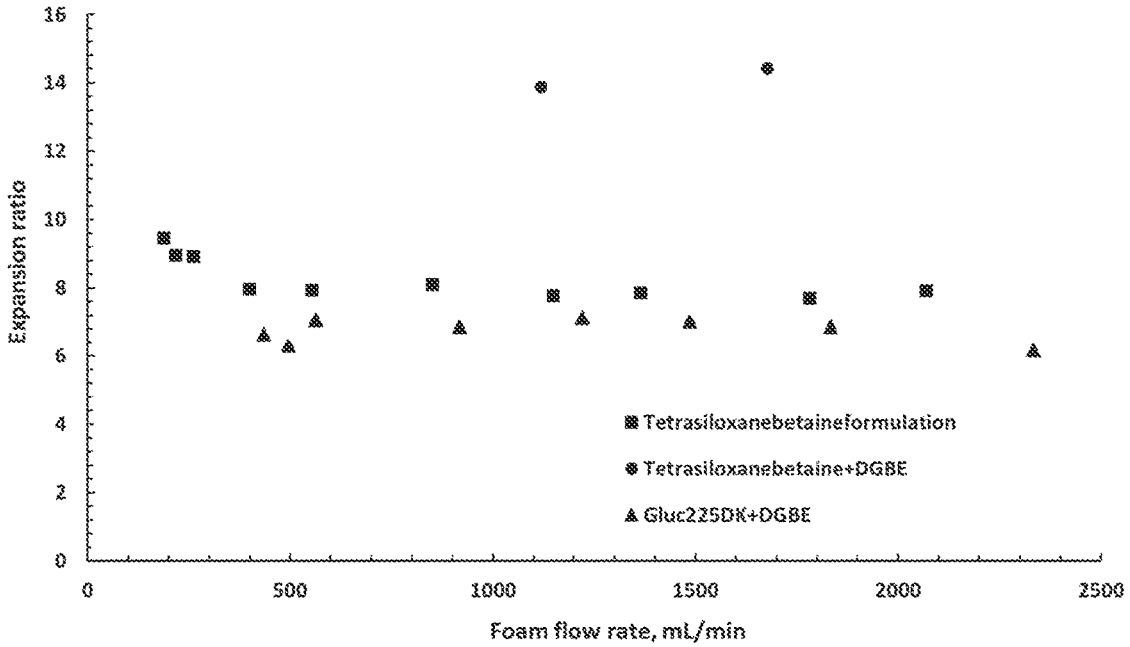

FIGS. 9A and B show expansion ratio versus foam flow rate for the formulations listed in Table 1. Initial expansion ratio is defined as the volume of foam divided by its weight. The expansion ratio is measured as soon as the foam is generated. As time progresses the expansion ratio increases due to liquid drainage from the foam. The initial expansion ratio stays relatively constant near 8.

Figure 10A:
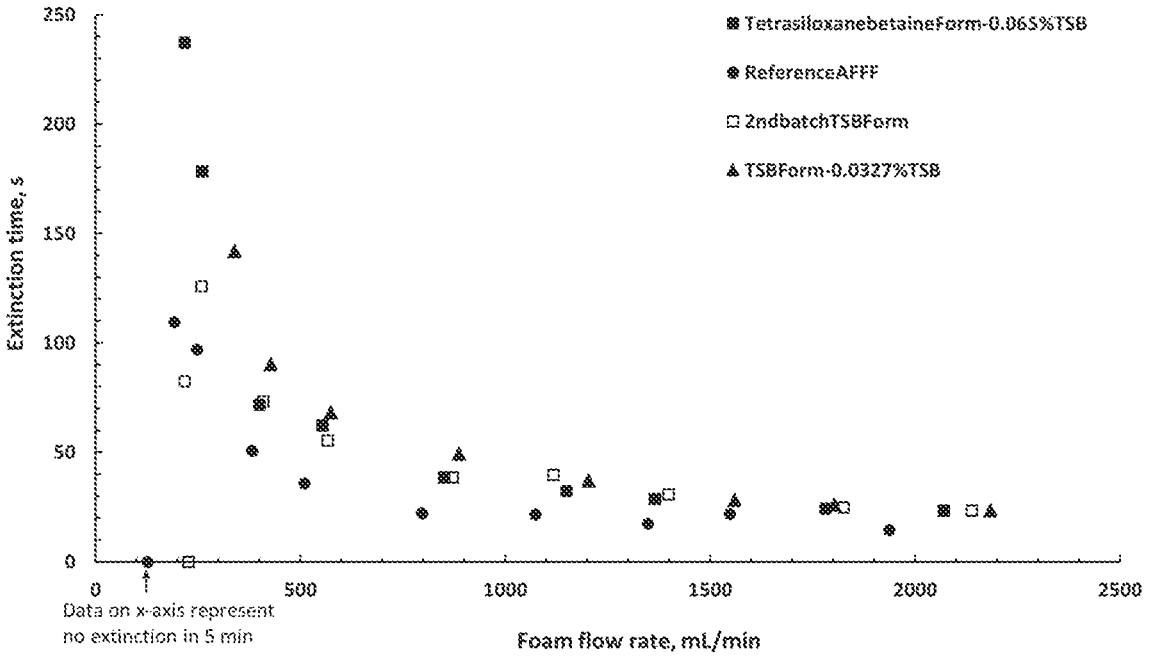
FIGS. 10A, B, and C show effects of decreasing the tetrasiloxanesulfobetaine (TSB) content in the formulation listed in column 1 of Table 1 from 0.065% to 0.0327%: (A) Extinction time vs foam flow rate, (B) 90% extinction time vs foam flow rate, and (B) coverage time vs foam flow rate.
Figure 10B:
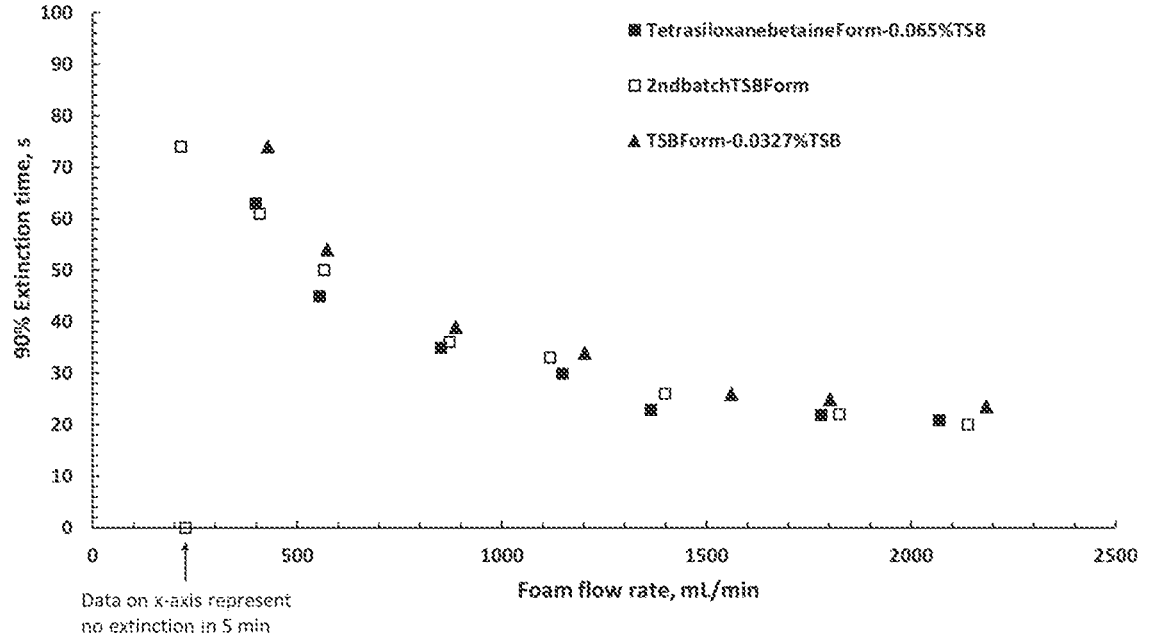
Figure 10C:
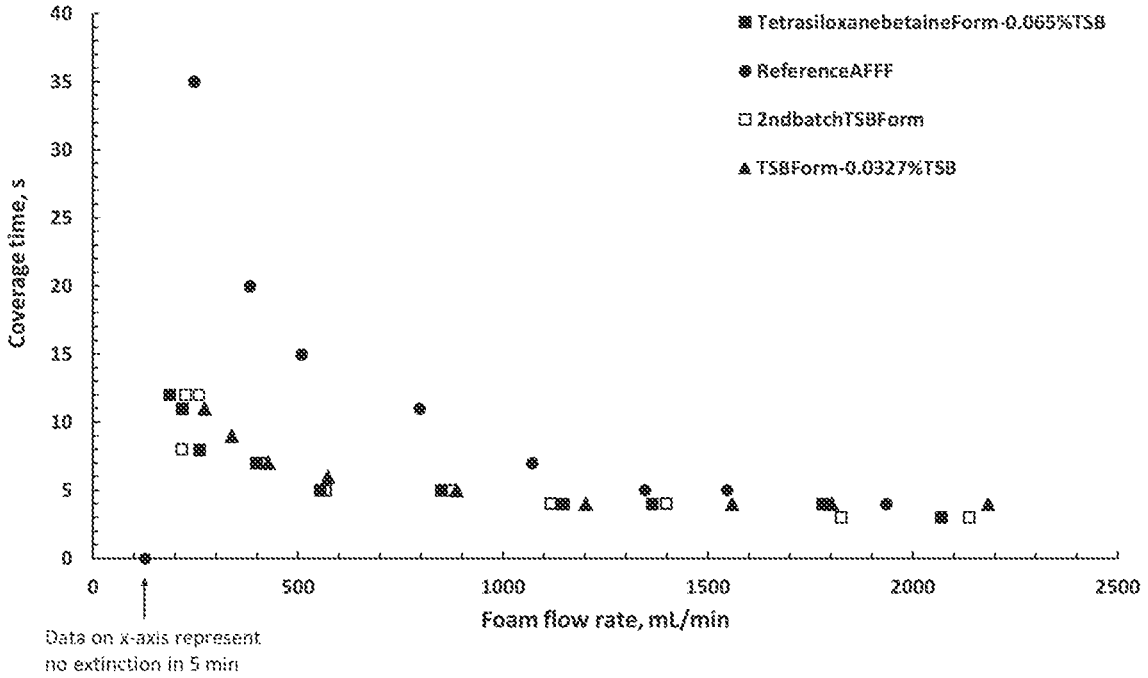

FIGS. 10A to C show the effect of varying the tetrasiloxanesulfobetaine (TSB) content in the formulation listed in the first column of Table 1. As the amount of TSB is reduced from 0.065 weight % to 0.0327 weight % in the formulation, the gasoline fire extinction time increased as indicated by the triangles in FIG. 10A, especially at low foam flow rates. A similar trend can be seen in 90% extinction time and coverage time in FIGS. 10B and C respectively.

Figure 11A:
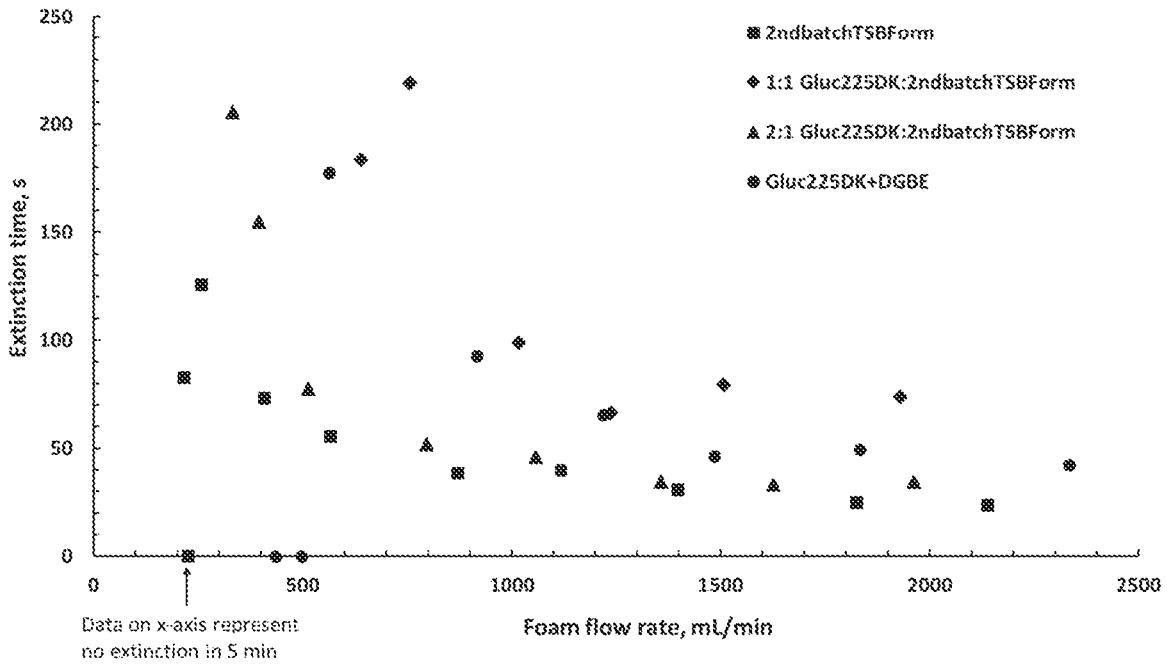
FIGS. 11A and B show effects of varying the Glucopn225DK content in the formulation listed in column 1 of Table 1 from 0.065 weight %, 0.13%, and 0.2%: (A) Extinction time vs foam flow rate, (B) Extinction time at 500 mL/min foam flow rate vs weight % Glucopon225DK.

FIGS. 11A and B show the effects varying the Glucopon225DK content from 0.2 weight % to 0.13 weight %, and to 0.065 weight % in the TSB formulation listed in column 1 of Table 1. The Glucopon225DK weight % 0.2, 0.13, 0.065 correspond to ratios of Glucopon225DK to TSB of 3:1 to 2:1, and to 1:1 respectively and are indicated in the legend of FIG. 11A. As the Glucopon225DK is decreased, the gasoline fire extinction time increases at all foam flow rates. At 1:1 ratio of Glucopon to TSB in the formulation, the extinction times are higher than the extinction times for the formulation containing only 0.2% Glucopon with 0.5%

Figure 11B:
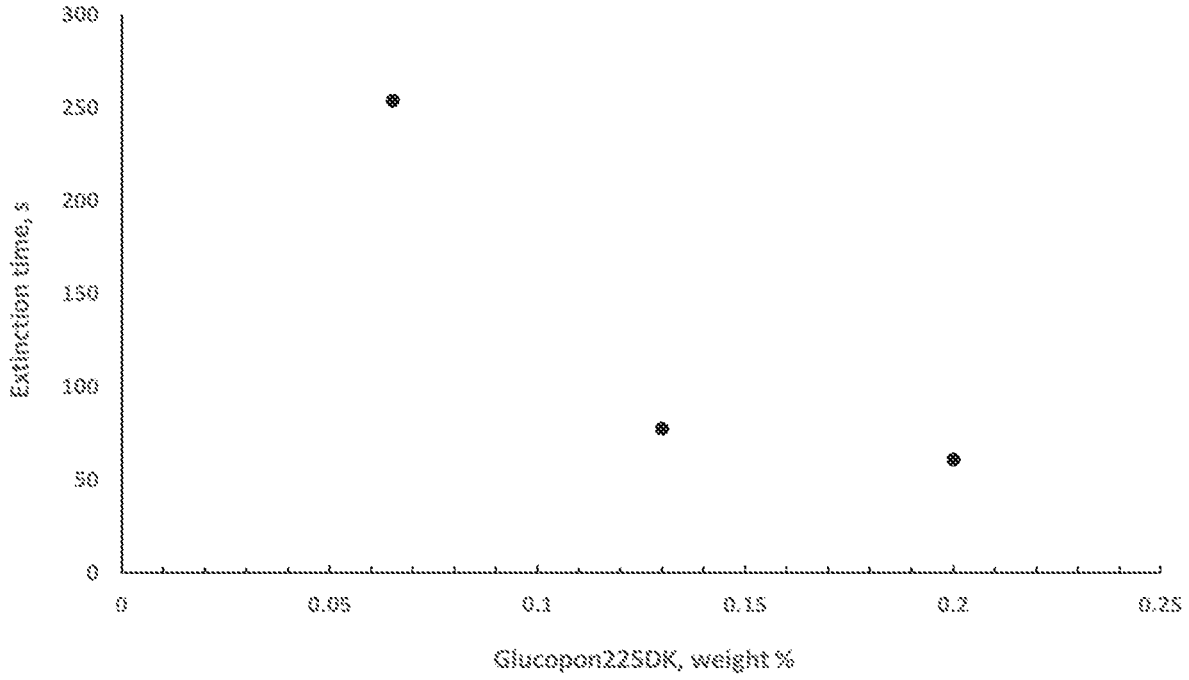

DGBE in water. FIG. 11B plots extinction time at 500 mL/min foam application rate vs Glucopon225DK % in the formulation. It shows a non-linear effect on extinction time.

Figure 12A:
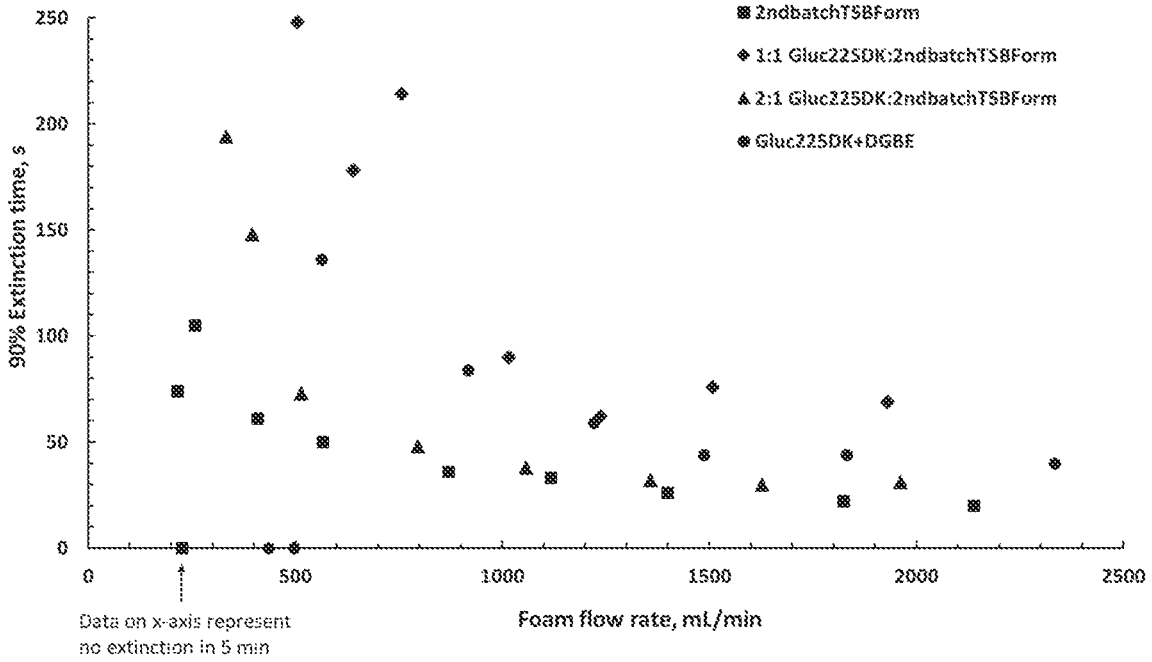
FIGS. 12A, B, and C show effects of varying the Glucopn225DK content in the formulation listed in column 1 of Table 1 from 0.065 weight %, 0.13%, and 0.2%: (A) 90% Extinction time vs foam flow rate, (B) Coverage time vs foam flow rate, (C) Foam expansion ratio vs foam flow rate.
Figure 12B:
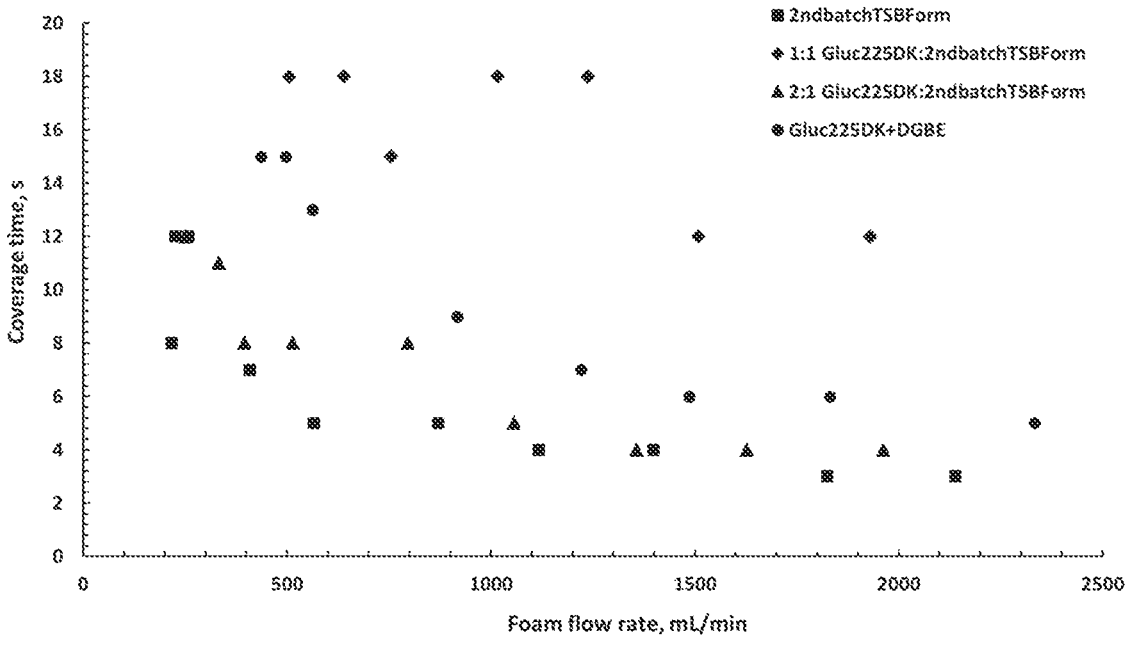
Figure 12C:
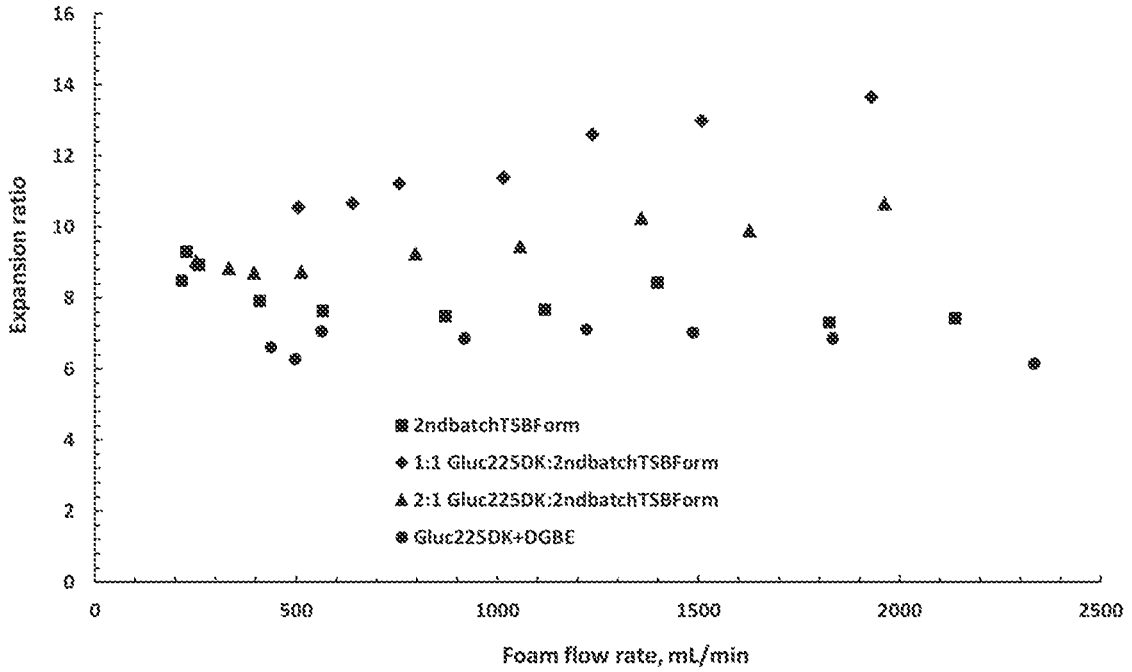

FIGS. 12A, B, and C show the effects of varying Glucopon content on 90% fire extinction time, pool coverage time, and initial expansion ratio of the foam respectively. The 90% extinction time and pool coverage time vs foam flow rate show trends similar to those shown in FIGS. 11A and B. FIG. 12C shows that the foam expansion ratio increases as the Glucopon content is decreased especially at high foam flow rates.

Different fuels and fires—It was previously shown that fluorine-free foams' fire suppression is affected by the type of fuel (gasoline versus heptane) more than AFFFs (NRL Memorandum Report NRL/MR/6123-19-9895). Synergism between two families of surfactants also depends on the fuel. Here it is shown that the present TSB formulation is especially effective in suppressing three different fuel fires; gasoline, Jet A, and JPS. TSB formulation is less effective at suppressing a heptane fire compared to the nonionic trisiloxane-502W formulation.

Figure 13A:
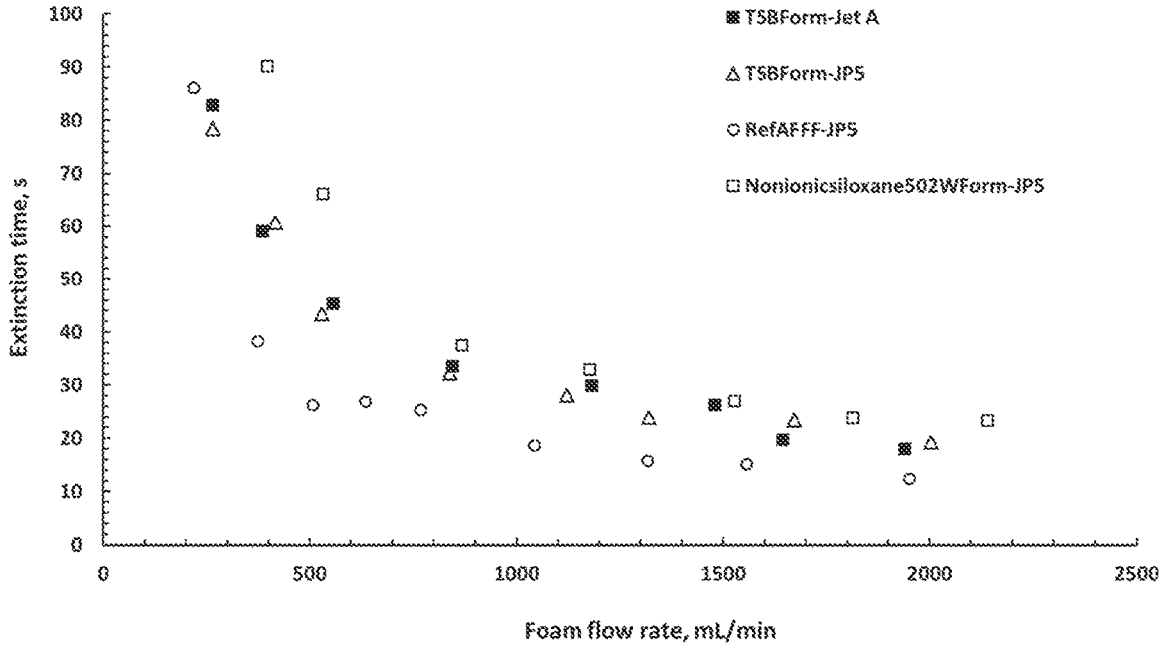
FIGS. 13A and B show jet fuel fire suppression with TSB formulation and comparison with RefAFFF and the siloxane 502W formulation listed in Table 1: (A) extinction time vs foam flow rate, (B) coverage time vs foam flow rate.
Figure 13B:
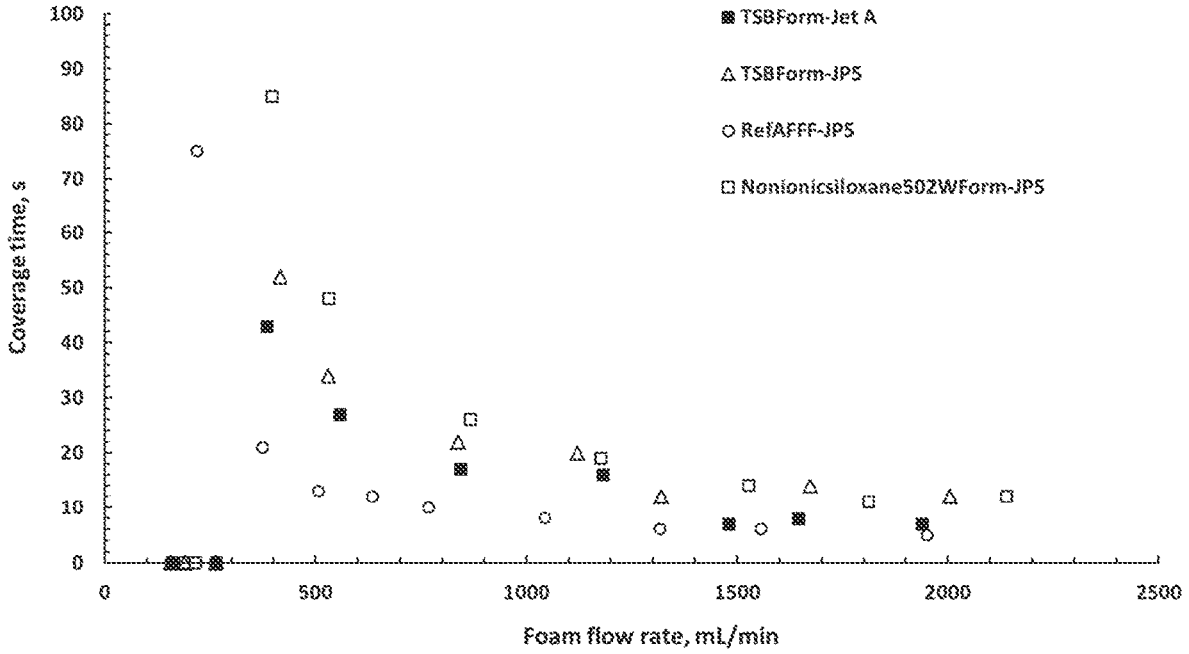

FIGS. 13A and B show extinction and coverage times on jet fuels respectively. As expected the jet fuel fires are extinguished quicker than gasoline fires. The extinction time versus foam flow rate profile for TSB formulation is a significant improvement over the siloxane 502W formulation and approaching that of RefAFFF. The differences between Jet A and JP-5 fire extinction profiles appear to be small. Interestingly, the pool coverage times for the TSB and the nonionic trisiloxane-502W formulations are larger for jet fuels than for gasoline. Indeed, the coverage times are relatively closer to the fire extinction times compared to the gasoline fires.

Figure 14A:
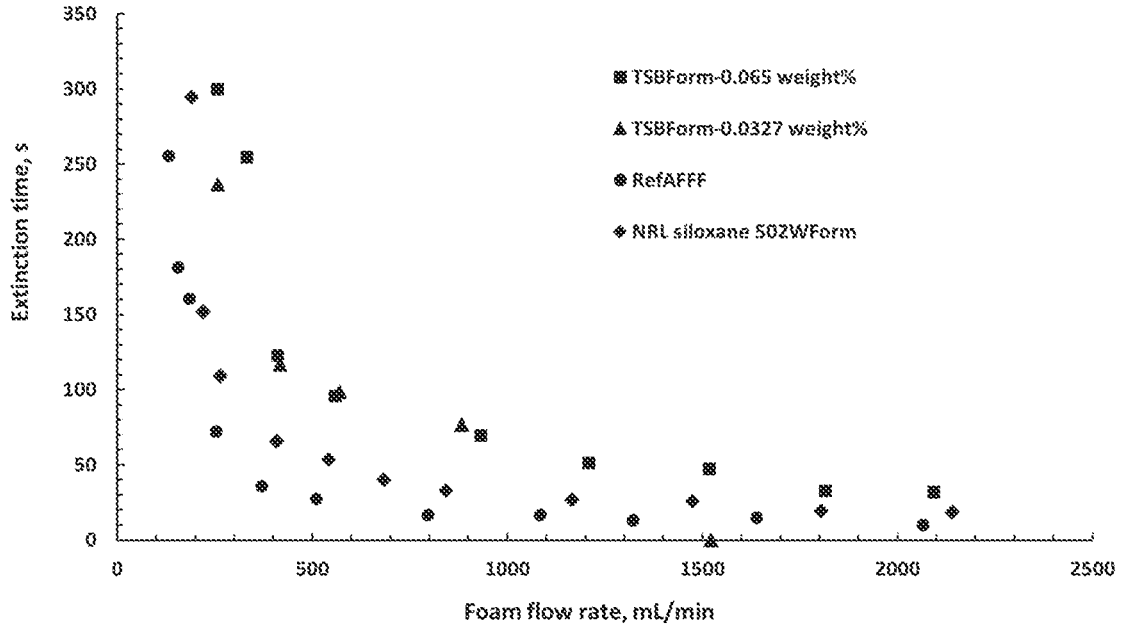
FIGS. 14A and B show heptane fuel fire suppression with TSB formulation and comparison with RefAFFF and the siloxane 502W formulation listed in Table 1: (A) extinction time vs foam flow rate, (B) coverage time vs foam flow rate.
Figure 14B:
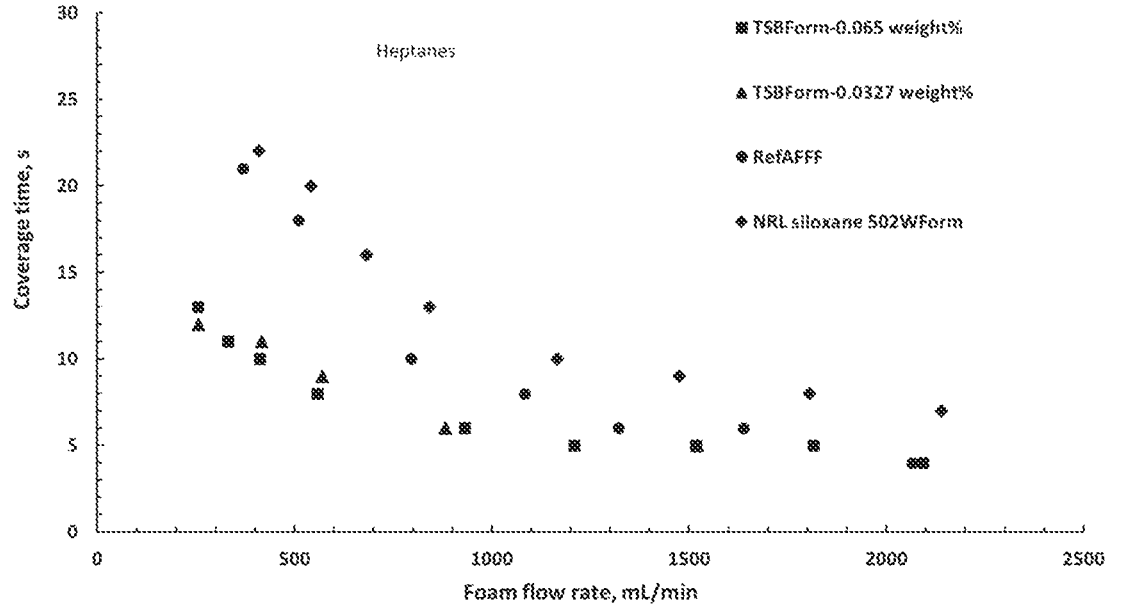

FIGS. 14A and B show fire extinction and pool coverage times for heptane fuel fires respectively. In this case, the siloxane 502W formulation has smaller extinction times than the present TSB formulation. This appears to most likely a lack of synergism between TSB and Glucopon225DK for heptane fires. Synergism between the nonionic siloxane 502W and Glucopon 225DK was previously shown as the cause for effective fire suppression of heptane fires (*Colloids and Surfaces A,* 579, 123686, 2019). The pool coverage times are smaller for the TSB formulation than the nonionic siloxane formulation and RefAFFF.

Figure 15A:
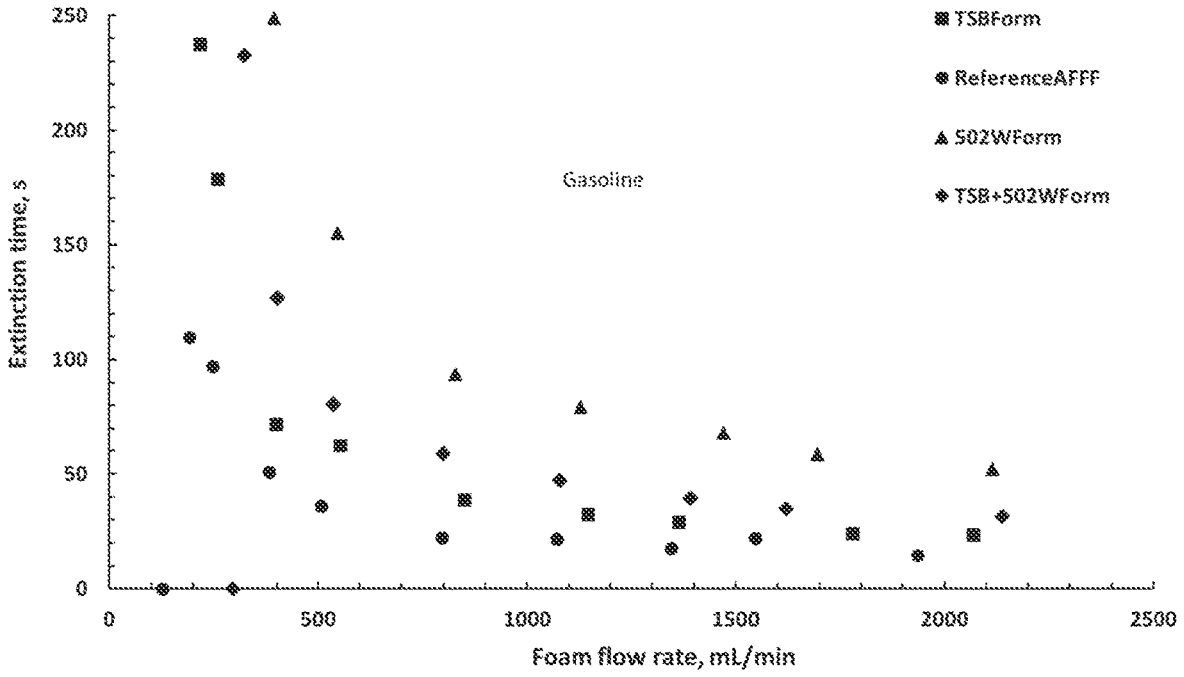
FIGS. 15A and B show gasoline fuel fire suppression with a mixture of TSB and the siloxane 502W formulation and comparison with RefAFFF and the siloxane 502W formulation: (A) extinction time vs foam flow rate, (B) coverage time vs foam flow rate.
Figure 15B:
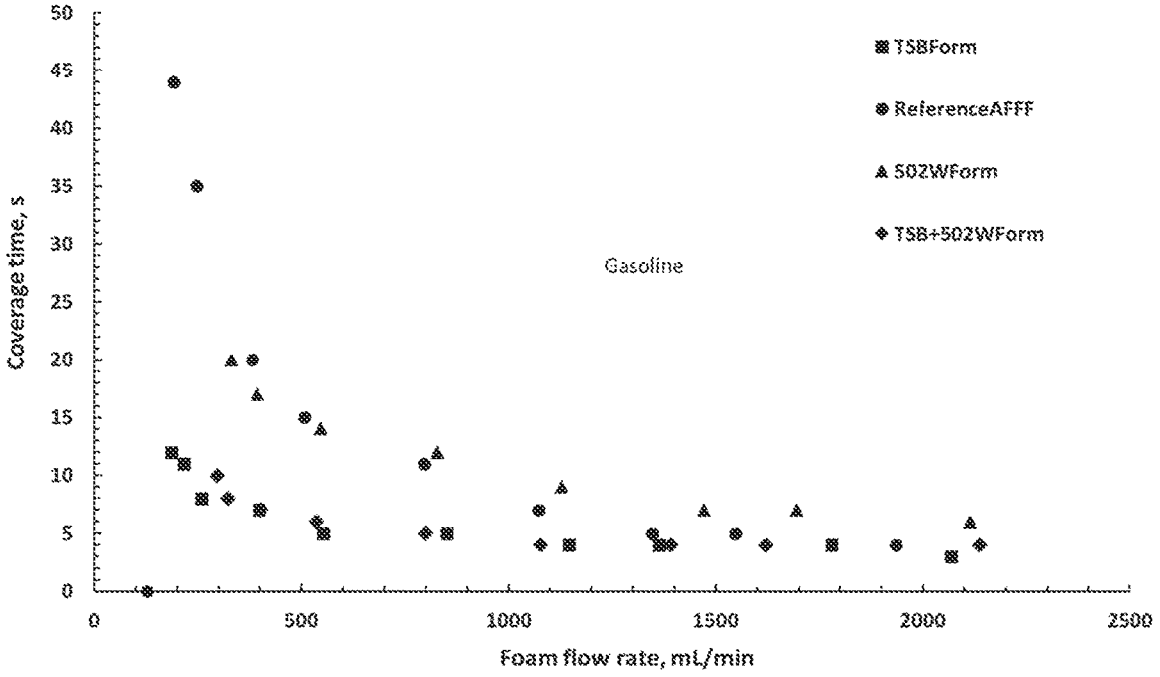
Figure 16A:
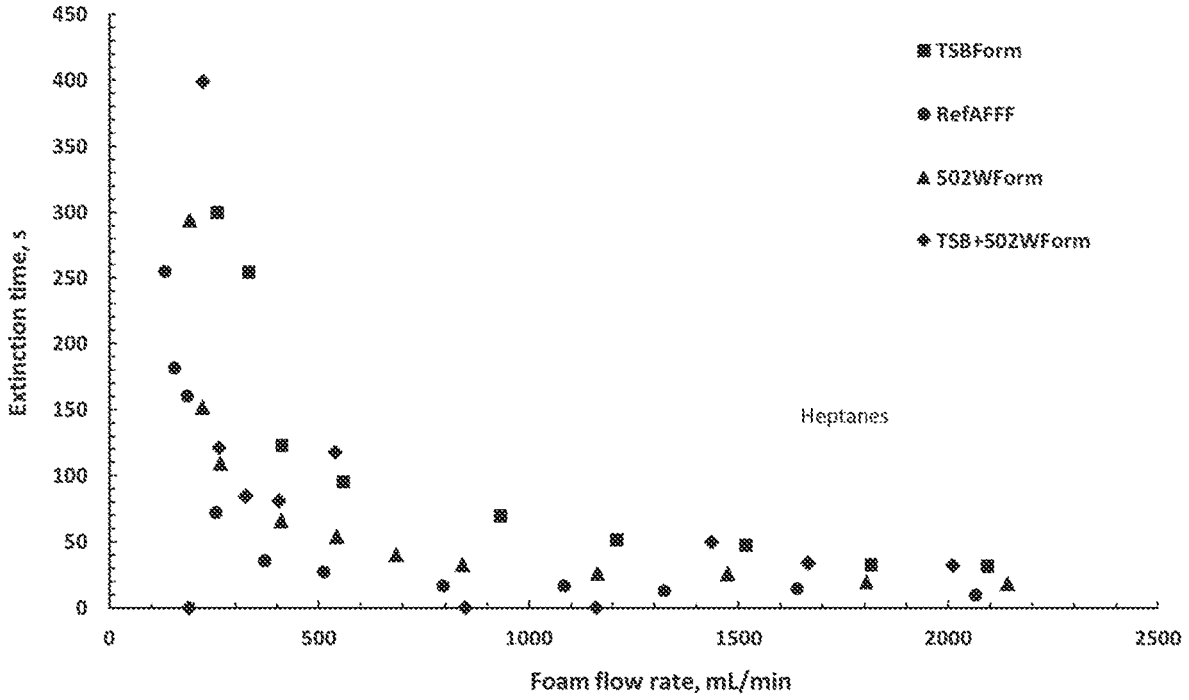
FIGS. 16A and B show heptane fuel fire suppression with a mixture of TSB and the siloxane 502W formulation and comparison with RefAFFF and the siloxane 502W formulation: (A) extinction time vs foam flow rate, (B) coverage time vs foam flow rate.
Figure 16B:
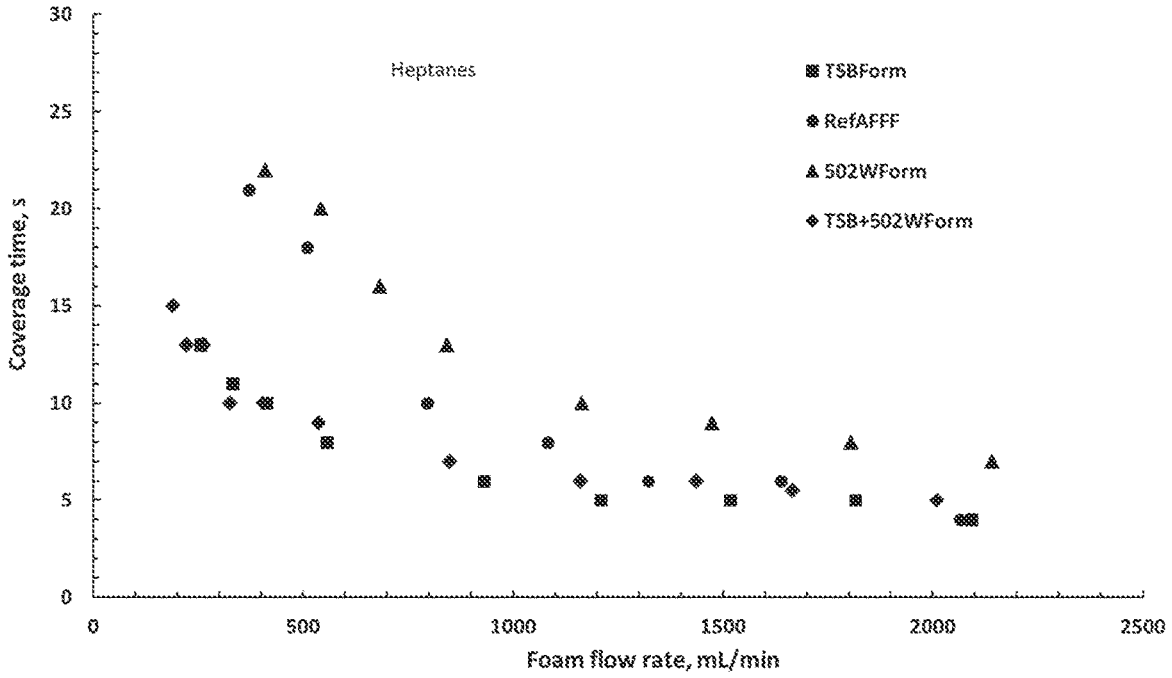

Mixture of ionic TSB and nonionic trisiloxane 502W—Bench scale fire suppression was conducted with a mixture of TSB and the nonionic siloxane formulation. This new formulation consists of 0.065% TSB, 0.3% g Glucopon225DK, and 0.5% DGBE by weight. As one might expect the extinction time results for the mixture appear to fall between TSB formulation and the siloxane 502W formulation as shown in FIG. 15A for gasoline fires and in FIG. 16A for heptane fires. The pool coverage times for the mixture are closer to those of TSB formulation as shown in FIG. 15B for gasoline fires and in FIG. 16B for heptane fires.

Foam degradation and fuel transport rate through foam—The TSB formulation showed improved fire suppression times over gasoline compared to the siloxane 502W formulation. Foam degradation and fuel transport were measured through a foam layer to explain the superior fire suppression of the TSBForm. The reason is due to the superior suppression of fuel transport rate through the foam layer.

Figure 17A:
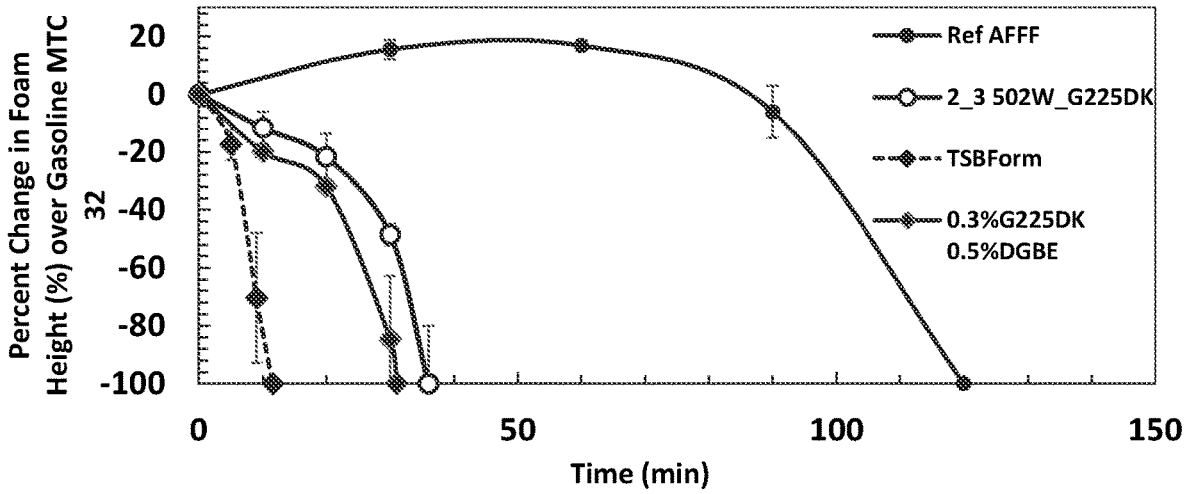
FIGS. 17A and B show degradation of 4-cm thick (initial thickness) foam covering fuel pool versus time: (A) warm gasoline pool (37° C.), (B) hot heptane pool (60° C.).

For gasoline degradation data, a gasoline pool is heated to 37° C. using a heating tape, controlled with a metal thermocouple (MTC) set to 32° C. 4 cm of foam is then generated on top of the pool and the foam height is monitored with time. The plot is shown in FIG. 17A and reports the percent change in foam height with time for the TSB surfactant in a formulation with G225DK and DGBE and for a solution of 0.3% G225DK 0.5% DGBE. These results for TSBForm are for the formulations containing the first batch of synthesized TSB surfactant, but the results are quantitatively consistent with degradation tests collected for the TSBForm containing the second batch of synthesized TSB. Data for the 502W formulation and Ref AFFF are also included for comparison. The reported error bars represent 2 standard deviations from 4 averaged trials for the TSBForm and 2 averaged trials for the 0.3% G225DK 0.5% DGBE. Despite the superior extinction performance of the TSBForm on gasoline, this data suggests it is not attributed to superior foam stability. The siloxane-502W formulation and 0.3% G225DK+DGBE have longer foam lifetimes than the TSBForm which degrade in 37, 31, and 11.5 minutes respectively. None of these foams come close to matching the foam degradation performance of a fluorinated material, the Ref AFFF, which does not fully degrade on gasoline heated to 37° C. until 120 minutes.

Figure 17B:
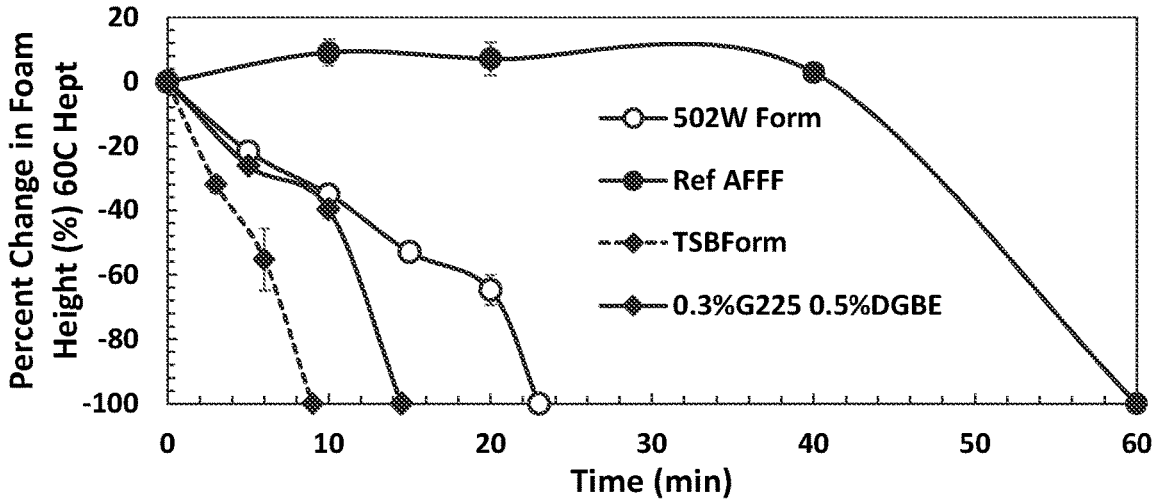

Degradation performance over heptane heated to a higher temperature of 60° C. was also evaluated. The same trends in degradation between the foams observed on gasoline were observed on heptane as shown in FIG. 17B. The 502W Formulation, 0.3% G225DK 0.5% DGBE, and TSBForm have foam lifetimes of 23, 14.5, and 9 minutes respectively over heptane. These are all significantly less than the foam lifetime of the Ref AFFF on heptane which is 60 minutes. An attempt was made to measure foam lifetime for the TSB surfactant+DGBE; however the foam degraded so quickly on heptane that a 4 cm foam layer never formed and data collection was not possible. Although there are significant differences in temperature and chemical composition between heptane and gasoline degradation testing, the TSBForm shows similar performance on both heptane and gasoline. The average foam lifetime of 9 minutes over heptane and 11.5 minutes over gasoline differ only by 25%. In contrast, the 502W formulation, 0.3% G225DK 0.5% DGBE, and Ref AFFF have percent differences of 47, 73, and 67%.

Figure 18:
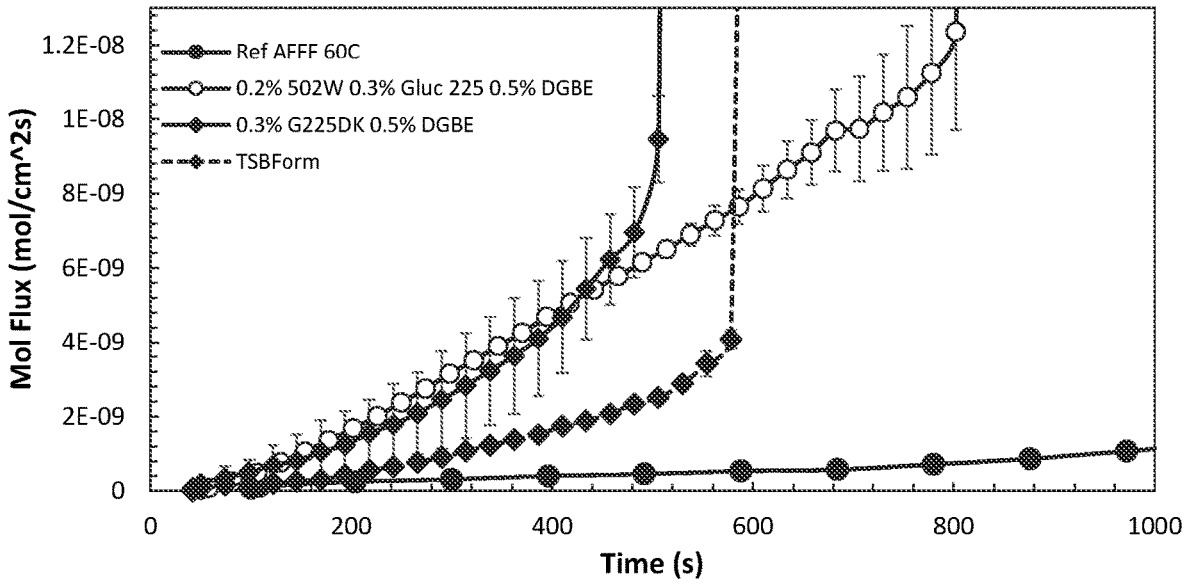
FIG. 18 shows heptane fuel mass flux emanating from the surface of a 4-cm thick (initial thickness) foam layer covering a hot (60° C.) heptane pool versus time.
Figure 19A:
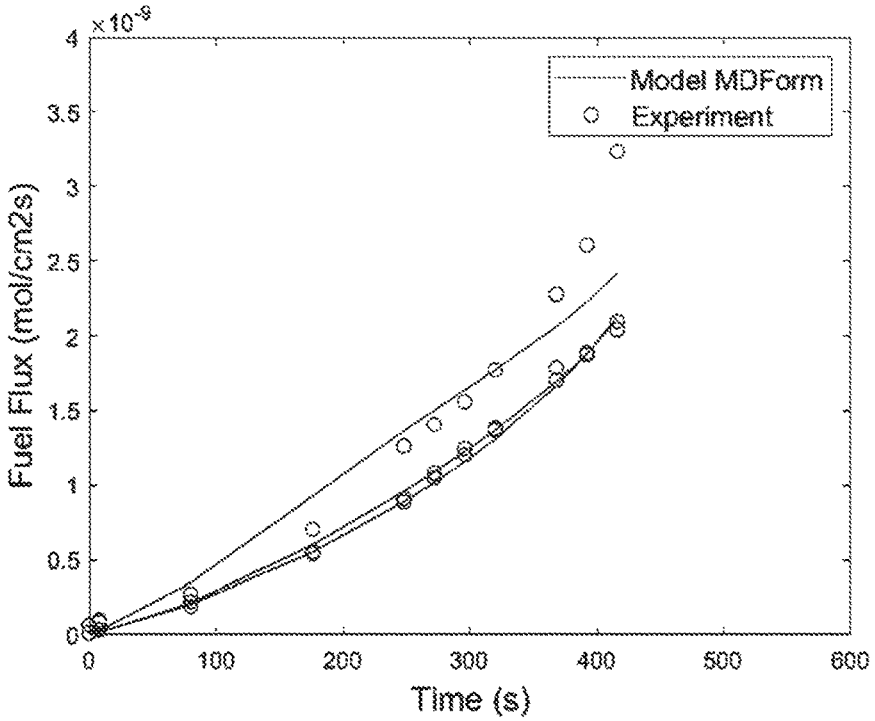
FIGS. 19A and B show Fick's law diffusion model fitted to the heptane fuel flux data displayed in FIG. 18. Instead of applying Fick's law to a constant foam layer thickness, a varying foam layer thickness with time displayed in FIG. 17B is used assuming a quasi-steady state at a given time.
Figure 19B:
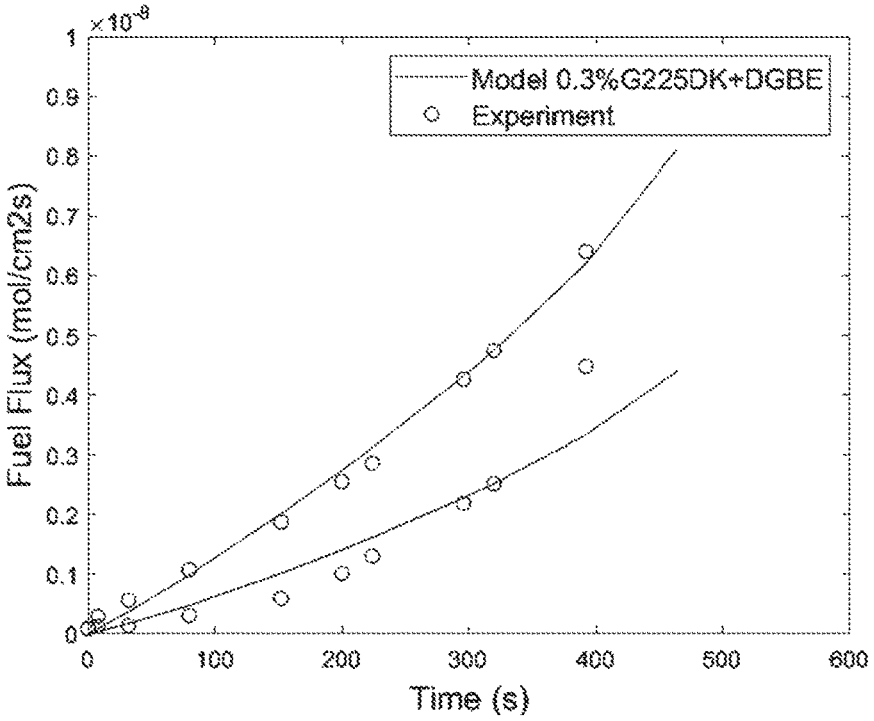
Figure 20:
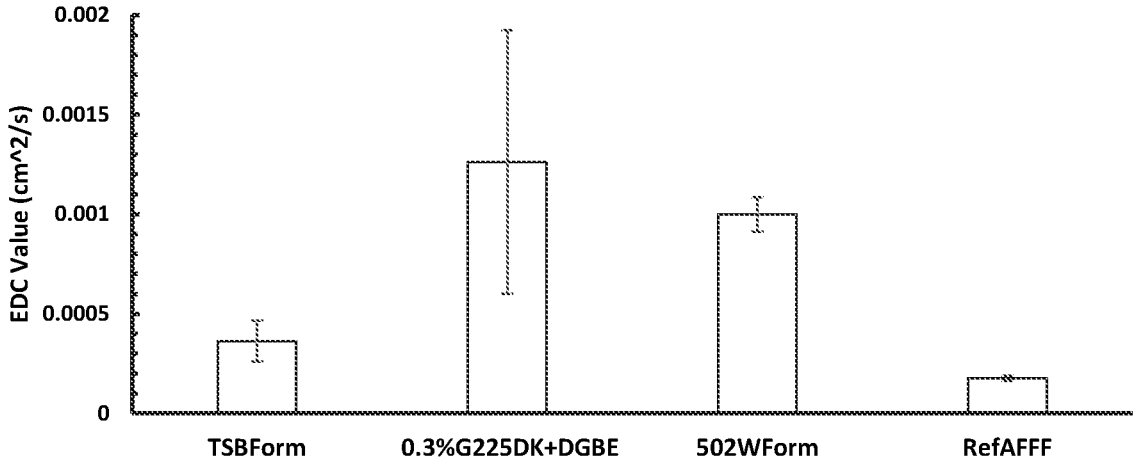
FIG. 20 shows effective diffusion coefficient (EDC) values for foams as determined from the quasi-steady Fick's law shown in FIGS. 19A and B.

Degradation performance does not appear to explain trends in fire extinction performance, so the fuel transport performance was evaluated as well. Because of issues with the IR signal of gasoline (a mixture of many components), fuel transport was only collected for heptane and is shown in FIG. 18. The raw fuel transport profiles in FIG. 18 were used with collected foam height data with time (collected during the fuel transport experiment) to derive an effective diffusion coefficient (EDC) by applying Fick's law. Fick's law was applied at any given time using the measured foam layer thickness instead of the initial foam layer thickness of 4-cm using a pseudo steady state approximation. The pseudo steady Fick's law model fitted to the fuel flux data are displayed in FIGS. 19A and B. The EDC values indicate the transport performance of the foams, independent of differences in foam degradation. A bar graph comparing calculated EDC values and errors are shown in FIG. 20. Plots include data for the TSBForm, 0.3% G225DK 0.5% DGBE, and additional foams for reference: RefAFFF and the siloxane502W Formulation.

From the fuel transport curves alone, it appears that the siloxane 502W formulation has a rate equal to that of the 0.3% G225DK+DGBE foam. The 502W formulation was shown to have a longer foam lifetime than the 0.3% G225DK+DGBE on gasoline and heptane previously (*Colloids and* Surfaces A, 579, 123686, 2019); however, heptane fuel transport measurements were not very different between the two foam formulations. This is further confirmed through the calculated EDC values which show that the 502W formulation and 0.3% G225DK+DGBE have similar heptane diffusion rates through the foam regardless of minor differences in foam height with time. Surprisingly the TSBForm has slower fuel transport through the foam than the 0.3% G225DK+DGBE. TSBForm has a statistically lower EDC value than 0.3% G225DK+DGBE and the siloxane 502W formulation. This is interesting in that addition of the TSB surfactant makes foam lifetime worse compared to the 0.3% G225DK+DGBE foam, but improves fuel transport performance. The calculated EDC value for the TSBForm is still statistically larger than the RefAFFF, but represents a significant improvement in transport performance over the siloxane 502W formulation. Additionally, this may represent synergism in transport performance as the TSBForm containing 0.3% G225DK+DGBE has slower transport than the 0.3% G225DK+DGBE alone. Due to the poor degradation performance of the TSB surfactant+DGBE, its EDC value could not be defined. It's possible that the surfactant has a strong ability to suppress fuel vapor transport even when it degrades too quickly. The improvement in EDC value of TSBForm over the siloxane 502W formulation is encouraging. Fuel transport results over heptane appear to align with trends in fire extinction performance over gasoline.

Large-scale testing of tetrasiloxanesulfobetaine—In all testing of the tetrasiloxane sulfobetaine material, the surfactant was mixed with G225DK and DGBE: 0.065% MD2062-124 0.3% G225DK 0.5% DGBE. Given the available surfactant quantity, 10 gallons of solution could be prepared, which limited the possible number of tests. Gasoline and Jet-A were prioritized as these are fuels likely to be included for screening future firefighting foams and for MilSpec qualification. Distilled water was pre-measured into 5 gallon buckets. The necessary quantities of G225DK and DGBE were dissolved with distilled water in 400 mL flasks. At the appropriate time, the MD 2062-124 was added to the flasks to dissolve. The flask contents were then poured into the 5 gallon containers before transport to CBD. The 5 gallon buckets were transported to CBD (roughly 1-1.5 hr lag time) and transferred to the testing tank.

Testing included gasoline extinction followed by a cold burnback, then Jet-A extinction. The gasoline extinction test was repeated and a hot burnback followed. Additional data collection included foam flow rate with a measured expansion ratio, MilSpec measured expansion ratio and 25% drainage time, as well as DFA measured drainage with time, bubble coarsening with time, and initial bubble size. In hot burnback test, the burnback was conducted immediately following extinction after a total of 90 seconds (includes extinction time) foam deposition. In cold burnback, the burnback was conducted using fresh gasoline, which is at room temperature and a 60 seconds foam deposition at 2 gallons/min solution flow rate. The results are shown in Table 2. The MDForm is a clear improvement over the 502WForm, extinguishing a gasoline pool fire while the 502WForm was unable to in 60 seconds. The MDForm also extinguishes faster on Jet-A compared to the 502WForm.

TABLE 2

| | Gasoline extinction (s) | Jet-A extinction (s) | Cold burnback gasoline (s) | Normal burnback gasoline (s) |
|---|---|---|---|---|
| MDForm | 62, 70 | 22 | 360 | 205 |
| 502WForm | >60, none observed | 39 | 144 | N/A |

Many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

What is claimed is:

1. A composition comprising:

a first surfactant having the formula:

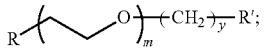

a second surfactant having the formula:

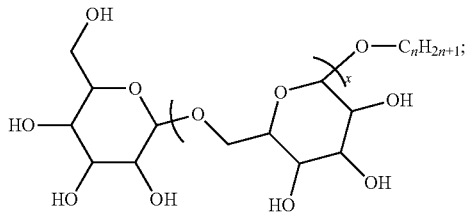

and water;

wherein m, x, and y are independently selected non-negative integers;

wherein n is a positive integer;

wherein R is a zwitterionic group; and wherein R' is a siloxane group.

2. The composition of claim 1, wherein the first surfactant has the formula:

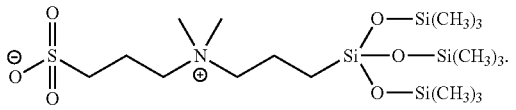

3. The composition of claim 1, wherein R is a sulfobetaine group or a chlorobetaine group.

4. The composition of claim 1, wherein m is from 0 to 20.

5. The composition of claim 1, wherein n is from 1 to 20.

6. The composition of claim 1, wherein x is from 0 to 4.

7. The composition of claim 1, wherein y is from 0 to 5.

8. The composition of claim 1, wherein the composition comprises more than one of the first surfactant or the second surfactant having different values of m, n, x, or y.

9. The composition of claim 1, wherein first surfactant and the second surfactant have a wt. % ratio of 0.03 to 5.

10. The composition of claim 1, wherein the composition further comprises:

a solvent having the formula:

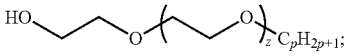

wherein p and z are positive integers.

11. The composition of claim 10, wherein p is from 1 to 8.

12. The composition of claim 10, wherein z is from 1 to 6.

13. A method comprising:

mixing the composition of claim 1 with air to form a foam.

14. The method of claim 13, further comprising:

applying the foam to a fire.

15. The method of claim 13, further comprising:

applying the foam to a fire in an amount sufficient to extinguish the fire.

16. A method comprising:

mixing a first surfactant, a second surfactant, and water to form a composition;

wherein the first surfactant has the formula:

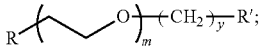

wherein the second surfactant has the formula:

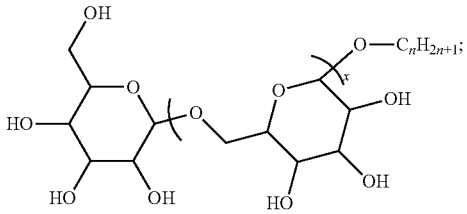

and water;

wherein m, x, and y are independently selected non-negative integers;

wherein n is a positive integer;

wherein R is a zwitterionic group; and wherein R' is a siloxane group.

17. The method of claim 16, wherein the first surfactant has the formula:

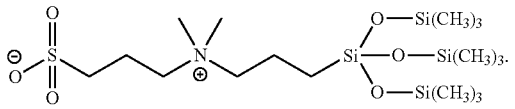

18. The method of claim 16, wherein the composition further comprises:

a solvent having the formula:

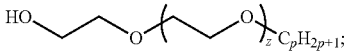

wherein p and z are positive integers.

* * * * *